US006890163B2

(12) United States Patent
Uchida et al.

(10) Patent No.: US 6,890,163 B2
(45) Date of Patent: May 10, 2005

(54) SCROLL COMPRESSOR

(75) Inventors: Kazuhide Uchida, Nishio (JP); Yoshitaka Akiyama, Chiryu (JP); Haruo Kamiya, Chiryu (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 10/679,325

(22) Filed: Oct. 7, 2003

(65) Prior Publication Data

US 2004/0071571 A1 Apr. 15, 2004

Related U.S. Application Data

(62) Division of application No. 10/174,820, filed on Jun. 20, 2002, now Pat. No. 6,695,599.

(30) Foreign Application Priority Data

Jun. 29, 2001 (JP) ..... 2001-199207
Mar. 7, 2002 (JP) ..... 2002-62115

(51) Int. Cl.[7] ..... F04C 18/00
(52) U.S. Cl. ..... 418/55.4; 418/55.5; 418/57
(58) Field of Search ..... 418/55.5, 57, 55.4, 418/55.1

(56) References Cited

U.S. PATENT DOCUMENTS 4,600,369 A 7/1986 Blain
4,645,437 A 2/1987 Sakashita et al.
4,993,928 A 2/1991 Fraser, Jr.
5,145,345 A 9/1992 Barito et al.
5,346,376 A 9/1994 Bookbinder et al.
5,447,418 A 9/1995 Takeda et al.
5,588,820 A 12/1996 Hill et al.
6,077,057 A * 6/2000 Hugenroth et al. ..... 418/55.4
6,146,119 A * 11/2000 Bush et al. ..... 418/55.4
6,171,088 B1 * 1/2001 Sun et al. ..... 418/55.4
6,224,059 B1 * 5/2001 Sun ..... 418/55.4

FOREIGN PATENT DOCUMENTS

JP A-2-176178 7/1990
JP A-9-310687 12/1997
JP A-2000-249086 9/2000

* cited by examiner

*Primary Examiner*—Theresa Trieu
(74) *Attorney, Agent, or Firm*—Posz Law Group, PLC

(57) ABSTRACT

A scroll compressor providing a ring-shaped groove in an end plate of a movable scroll to form a backpressure chamber with a surface of a middle housing supporting the end plate and introducing a high-pressure fluid through the same so as to cancel out a thrust load generated by the compression reaction force. Inner and outer seal rings are provided to prevent leakage of the high-pressure fluid from the backpressure chamber. In this case, the seal rings are designed to be able to incline in the ring-shaped groove or O-rings are made joint use of to form a ring-shaped region of a higher contact pressure at a portion contacting the opposing surface, so a high sealing effect is obtained while suppressing mechanical loss.

5 Claims, 20 Drawing Sheets

SCROLL COMPRESSOR

Divisional of prior application Ser. No. 10/174,820, filed on Jun. 20, 2000 now U.S. Pat. No. 6,695,599.

BACKGROUND OF THE INVENTION

The present invention relates to a scroll compressor, more particularly relates to a seal means suitable for providing a backpressure chamber supporting a thrust load of a scroll compressor.

As described in Japanese Unexamined Patent Publication (Kokai) No. 2-176178, when driving a movable scroll to compress a fluid in a scroll compressor, a thrust load pressing the movable scroll to the fixed housing side is generated due to the compression reaction force. To support this thrust load, a ring-shaped thrust load support member comprised of a member comprised basically of for example cobalt or nickel and including a secondary ingredient such as molybdenum, chrome, silicon, or carbon or a wear resistant material comprised of carbon fiber bound by an epoxy resin is used between a back surface of an end plate of the movable scroll and the surface on the housing side facing this. With this configuration, however, heat of friction due to the sliding action is generated between the front surface of the thrust load support member and the surface of the opposing member and wear progresses, so in the related art, the measure has been devised of providing a groove in the ring-shaped thrust load support member to supply cooling water to absorb the heat of friction.

To suppress the heat of friction or wear in the thrust load support member generated in this way, as described in the invention previously proposed by the inventors and disclosed in Japanese Unexamined Patent Publication (Kokai) No. 9-310687, there is known a scroll compressor formed with a backpressure chamber as a recessed space in a back surface of an end plate of a movable scroll and guiding a compressed fluid from a discharge side to this backpressure chamber to cause the generation of a backpressure and thereby bias the movable scroll in an axial direction and reduce the large contact load acting between the back surface of the flat surface of the movable scroll on the housing side generated by the compression reaction force.

When working the related art described above, if the fluid to be compressed is one with a low working pressure as with the chlorofluorocarbons generally used as refrigerants in refrigeration cycles, the thrust load generated due to the compression force is around 1000N, so the pressure of the fluid introduced into the backpressure chamber of the back surface of the movable scroll may be low. Therefore, even if using a seal material for holding the pressure in the backpressure chamber, the load acting on the seal member will not become that large. Further, since the contact load is small, the lubrication state of the sliding surface of the seal member is believed to be in the fluid lubrication region, so an oil film is reliably formed on the surface of the housing side in sliding contact with the seal member and sliding contact is believed to be performed with a low coefficient of friction. Therefore, the mechanical loss due to the sliding action of the seal member can be kept low.

In a refrigeration cycle using as a refrigerant a so-called supercritical pressure fluid such as carbon dioxide ($CO_2$), however, when compressing the refrigerant by a scroll compressor shown in the above related art, the thrust load acting on the movable scroll reaches as much as 7000N or about seven times the case of use of a refrigerant having a low working pressure such as a chlorofluorocarbon, so the pressure of the fluid introduced into the backpressure chamber similarly becomes a seven times higher pressure. This high-pressure acts on the seal member. Further, since the load acting on the seal member is high, the lubrication state of the sliding surface of the seal member is not in the fluid lubrication region, but is believed to be in the mixed lubrication region or boundary lubrication region where the coefficient of friction is high. Therefore, there is the problem that the mechanical loss due to the sliding action of the seal member becomes larger and causes a reduction in the efficiency of the compressor.

Therefore, in the related art later proposed by the inventors and disclosed in Japanese Unexamined Patent Publication (Kokai) No. 2000-249086, there is described a scroll compressor using a supercritical pressure fluid as the refrigerant providing a seal member in a backpressure chamber of a movable scroll and taking out relatively low pressure refrigerant not yet compressed to a sufficiently high-pressure in the working chambers and supplying it to the backpressure chamber through a check valve so as to prevent in advance leakage of a large amount of high-pressure refrigerant from the backpressure chamber and so as to suppress an increase in the wear of the seal member or mechanical loss.

In this way, while the provision of a backpressure chamber behind an end plate of a movable scroll in order to support the thrust load in a scroll compressor and the provision of a seal member in the backpressure chamber in order to prevent leakage of the compressed fluid from the backpressure chamber are known even in a scroll compressor compressing a supercritical pressure fluid, details such as how to provide what kind of shape of seal member in the backpressure chamber have not yet been sufficiently researched.

Later research by the inventors proposing the above related art revealed that use of a seal member for the backpressure chamber having a joint such as in a piston ring of an internal combustion engine resulted in the problem of a large amount of high-pressure fluid supplied to the backpressure chamber leaking from the joint and that use of a continuous ring-shaped seal member not having any joint resulted in the problem of the compressed fluid entering the clearance between the seal member and wall surface of the backpressure chamber and therefore deformation of the seal member and obstruction of the action of closely contacting the wall surface of the backpressure chamber or the wall surface of the housing and a consequent inability to obtain a sufficient sealing effect.

SUMMARY OF THE INVENTION

An object of the present invention is to eliminate these problems in the related art by providing a seal means of a novel configuration in the backpressure chamber of a scroll compressor.

In order to deal with the above problems in the related art, the present invention provides a scroll compressor provided with a housing, a shaft having a crank part rotatably supported by the housing and partially offset, and a movable scroll having a spiral shaped blade and end plate and driven to orbit by the crank part of the shaft, and a fixed scroll having a spiral shaped blade meshing with the movable scroll and end plate and fixed to said housing, where when the movable scroll is driven to orbit by the crank part of the shaft, while a plurality of working chambers formed between the blade of the movable scroll and the blade of the fixed scroll move toward the center, the volumes of the working chambers are successively reduced and thereby the fluid is compressed in the working chambers, the scroll compressor further provided with: a middle housing provided as part of the housing behind the movable scroll for supporting a thrust load in an axial direction of the shaft acting on the movable scroll along with the rise in the compression pressure of the fluid in the working chambers; at least one ring-shaped groove forming a backpressure chamber in one of a back surface of the end plate of the movable scroll and a front surface of the middle housing facing and supporting the same; a passage for introducing high-pressure fluid into the ring-shaped groove; and at least one ring-shaped seal ring fit movably in the ring-shaped groove.

In the scroll compressor of the present invention, at least one backpressure chamber is formed in either of a back surface of an end plate of a movable scroll and a front surface of a middle housing facing the same and a high-pressure fluid compressed in a working chamber is introduced into the backpressure chamber in order to pressurize the backpressure chamber, so a thrust load acting on a sliding contact surface supporting the movable scroll in an axial direction by the middle housing becomes smaller. Even when the working pressure becomes extremely high due to use by the compressor for compressing a supercritical pressure fluid etc., the thrust load supporting surface of the movable scroll becomes a fluid lubrication state, so the coefficient of friction becomes small and the mechanical loss is reduced.

In the scroll compressor of the present invention, leakage of the high-pressure fluid introduced into the backpressure chamber to the suction chamber or other low-pressure side is prevented by fitting at least one seal ring in the backpressure chamber. One of the characterizing features of the present invention is that this seal ring can move in the backpressure chamber. Therefore, if a high-pressure fluid is supplied into the backpressure chamber, this pressure causes the seal ring to move in the backpressure chamber and be pressed against the other surface, whereby the contact pressure required for sealing is generated.

In the present invention, as one mode of movement of the seal ring, the seal ring can incline (move) slightly in sectional shape due to being pressed by the high-pressure fluid in the backpressure chamber and thereby form a narrow width ring-shaped contact region where the backpressure becomes higher with the other surface it contacts. A high sealing action is obtained by the higher contact pressure, narrow width, ring-shaped contact region, so leakage of the high-pressure fluid from the backpressure chamber is prevented. The seal ring is biased by the high-pressure fluid introduced into the backpressure chamber, but to further additionally bias the seal ring, it is possible to provide an elastic member behind the seal ring.

In the scroll compressor of the present invention, it is possible to provide two seal rings in one backpressure chamber. In this case, a first seal ring is fit along an outer circumference of a ring-shaped groove forming the backpressure chamber, while a second seal ring is fit along an inner circumference of the ring-shaped groove. These seal rings can be fabricated from materials such as rubber, plastic, or metal having wear resistance and oil resistance and elasticity. The first seal ring can be made one having a portion facing the portion of the outer circumference of the ring-shaped groove close to the bottom of the groove which forms a ring-shaped projection of a larger outer diameter than the diameter of the outer circumference of the ring-shaped groove in the no-load state before being fit in the backpressure chamber, while the second seal ring can be made one having a portion facing the portion of the inner circumference of the ring-shaped groove close to the bottom of the groove which forms a ring-shaped projection of a smaller inner diameter than the diameter of the inner circumference of the ring-shaped groove in the no-load state before being fit in the backpressure chamber. Due to this, the sectional shapes of the first and second seal rings incline (move) more easily in the backpressure chamber.

To form the ring-shaped projections at the seal rings, it is possible to form tapered surfaces at least at part of the outer circumference of the first seal ring and the inner circumference of the second seal ring. Due to this, it is possible to form sharp edge projecting rims at part of the ring-shaped projections to enhance the contact pressure and the sealing action. Further, it is possible to arrange an elastic member between the first seal ring and second seal ring to bias the first seal ring toward the outer circumference of the ring-shaped groove and bias the second seal ring toward the inner circumference of the ring-shaped groove. The biasing action of the elastic member improves the sealing action of the seal ring. Note that even when the sectional shapes of the first and second seal rings in the no-load state before being fit in the backpressure chamber are made rectangular, including square, and are not formed with ring-shaped projections, the corners of the rectangular sectional shapes act as ring-shaped projections, so substantially the same effects are obtained.

In the present invention, instead of independent seal rings, it is possible to integrally form a first seal ring part to be fit along the outer circumference of the ring-shaped groove forming the backpressure chamber, a second seal ring part to be fit along the inner circumference of the ring-shaped groove, and a connecting part integrally connecting the first seal ring part and second seal ring part. This reduces the number of parts, so facilitates assembly and reduces costs. Note that when there is a connecting part, it is possible to use at least part of that connecting part as a seal ring part and bring it into direct contact with the surface of the middle housing or other member. These parts of the integrally formed seal ring may also be fabricated by a material such as rubber, plastic, or metal having wear resistance, oil resistance, and elasticity.

When there is a connecting part, it is possible to form at least one communicating hole in the connecting part. Due to this, the same pressure acts at the two sides of the connecting part, so even when two seal ring parts are connected by the connecting part, the two seal ring parts work in the same way as if they were independent. When the two seal ring parts are connected in this way, it is possible to arrange an elastic member between the first seal ring part and second seal ring part to bias the first seal ring part toward the outer circumference of the ring-shaped groove and bias the second seal ring part toward the inner circumference of the ring-shaped groove.

In the scroll compressor of the present invention, it is possible to provide a seal ring in the backpressure chamber and enable it to move toward the surface of the other member and to provide an elastic ring-shaped seal member such as an O-ring between its side surface and the side surface of the ring-shaped groove (backpressure chamber) facing it to complementarily seal that portion.

The seal ring in this case may be made one having a superior self-lubricating action and high hardness by selecting one comprised mainly of for example carbon, metal, plastic, or ceramic. While this enables the wear resistance at the surface in sliding contact with the other member to be enhanced, the sealing action between the seal ring and the wall surface of the ring-shaped groove (backpressure chamber) receiving it may fall, but the O-ring or other ring-shaped sealing member supplements the sealing action at that portion, so a high sealing action is obtained as a whole.

The O-ring or other ring-shaped seal member can be stably supported at a predetermined position of one of the seal ring or wall surface of the backpressure chamber (ring-shaped groove) facing the same by forming a support part such as a ring-shaped groove or cutout part at that position.

In the scroll compressor of the present invention, it is possible to form a flange increasing the sliding area with the opposing surface at the ring-shaped seal ring sealing the backpressure chamber. This increases the seal area and enables a reduction of the contact pressure, so can reduce the wear due to the sliding friction. Further, since the seal ring presses against the other surface, it is possible to cause the high-pressure fluid to reliably act on a predetermined surface of the seal ring.

Even when using a seal ring having a superior self-lubricating action and high hardness which is resistant to deformation, it is possible to form the seal ring by a first seal ring part to be fit along the outer circumference of the ring-shaped groove forming the backpressure chamber, a second seal ring part to be fit along the inner circumference of the ring-shaped groove, and a connecting part integrally connecting the first seal ring part and second seal ring part. This reduces the number of parts and facilitates assembly. In this case as well, it is possible to form communicating holes in the connecting part connecting the two seal ring parts to cause the two seal ring parts to function in the same way as two independent seal rings.

The scroll compressor of the present invention may be configured as a "motorized type" where a motor directly attached to the housing directly drives the rotation of its shaft or may be configured so that an external prime mover such as an internal combustion engine mounted in a vehicle drives the rotation of its shaft. One of the preferred applications for the scroll compressor of the present invention is that of a refrigeration compressor where the fluid to be compressed is a refrigerant flowing through a refrigeration cycle, in particular one set so that the pressure of the refrigerant after being compressed becomes a level of at least the critical pressure of the refrigerant.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Preferred embodiments of the present invention will be described in detail below while referring to the attached figures.

Figure 1:
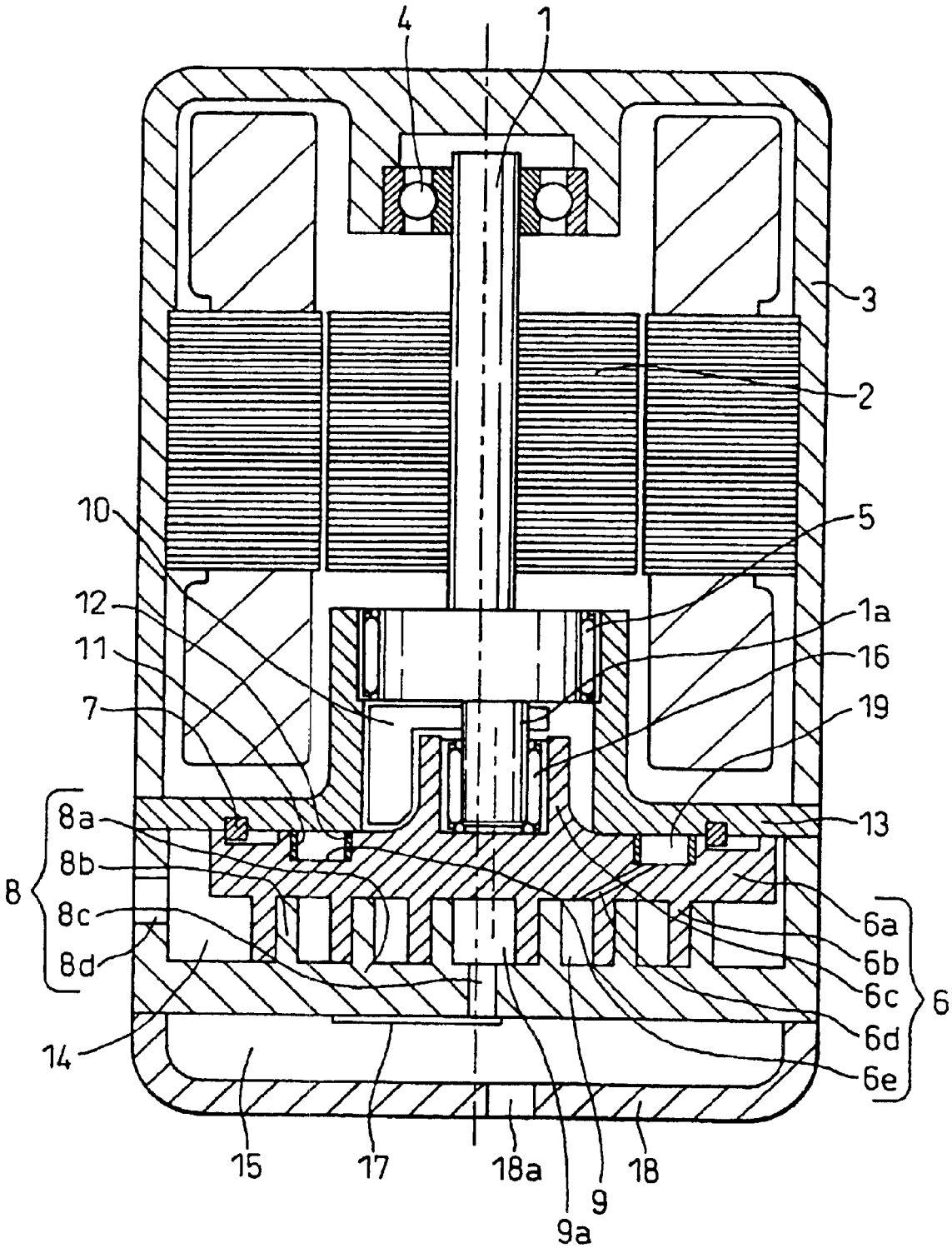
FIG. 1 is a longitudinal sectional view of a first embodiment of the present invention.
Figure 2:
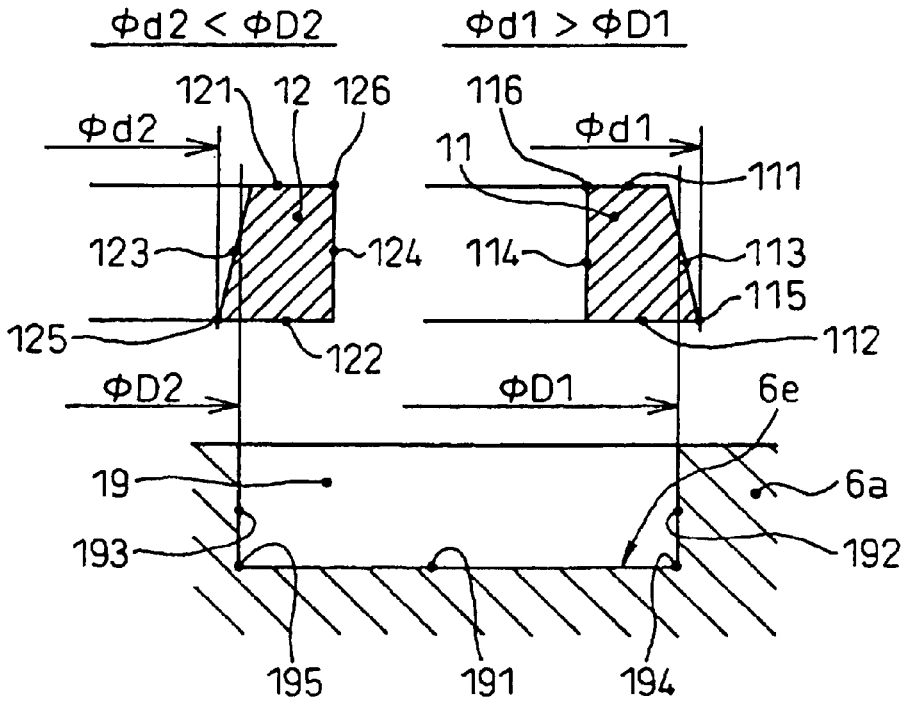
FIG. 2 is an enlarged sectional view of principal parts of the first embodiment.

FIG. 1 and FIG. 2 will be used to explain a first embodiment of a scroll compressor of the present invention. In FIG. 1, reference numeral 1 is a shaft formed at its bottom end with a crank 1*a* offset from the axis by exactly a predetermined amount. Reference numeral 2 is a motor, which drives the rotation of the shaft 1 when powered. In the case of the first embodiment, the motor 2 is provided inside a motor housing 3 formed integrally with a housing of the compressor. Reference numeral 4 is a front radial bearing attached to the top part of the motor housing 3 and rotatably supports the shaft 1 together with a rear radial bearing 5 attached to the bottom part. Note that the present invention is not limited to application to a scroll compressor having a built-in motor and may also be applied to a scroll compressor where the prime mover driving the rotation of the shaft 1 is separate such as in an internal combustion engine mounted in a vehicle.

Reference numeral 6 is a movable scroll comprised of a roughly disk-shaped end plate 6*a*, a blade 6*b* of a spiral shape formed projecting out from the same in the axial direction, and a cylindrical boss 6*c* formed at the back surface of the end plate 6*a*. The movable scroll 6 as a whole is supported rotatably by the crank 1*a* of the shaft 1 through a movable scroll bearing 16 press-fit into the boss 6*c* for attachment and orbits around the center axis of the shaft 1. Reference numeral 7 indicates a plurality of stop pins allowing only orbiting motion of the movable scroll 6 and preventing rotation of the scroll 6.

Reference numeral 8 is a fixed scroll provided with an end plate 8*a* and spiral shaped blade 8*b* similar to those of the movable scroll 6 and assembled to mesh with the movable scroll 6. An outside cylinder of the fixed scroll 8 serves also as the housing of the compressor portion of the scroll compressor. The spiral shaped blade 8*b* of the fixed scroll 8 and the spiral shaped blade 6*b* of the movable scroll 6 mesh to form a plurality of working chambers 9, appearing as crescent shapes when viewed in the axial direction, between these blades 6*b* and 8*b*.

The scroll compressor sucks a fluid such as a gaseous refrigerant returned from a not shown refrigeration cycle and introduced from a suction port 8*d* to a suction chamber 14 into the working chambers 9 when the working chambers 9 open toward the suction chamber 14 at their outer circumferences and compresses the fluid by the shrinkage of the working chambers 9 when moving in the radial direction toward the center of the movable scroll 6 and fixed scroll 8 during orbiting of the movable scroll 6. Finally, when the working chambers 9 open toward a center working chamber 9*a*, the refrigerant reaching the discharge pressure passes through a discharge port 8*c* provided in the end plate 8*a* of the fixed scroll 8 and is discharged into a discharge chamber 15 formed between the end plate 8*a* and a rear housing 18 fixed to the fixed scroll 8 by not shown bolts.

Reference numeral 18*a* is a discharge port formed in the rear housing 18. This is connected to the refrigeration cycle by not showing piping and leads high-pressure refrigerant discharged into the discharge chamber 15 to a condenser of the refrigeration cycle. Reference numeral 17 is a discharge valve, which is attached to the end plate 8*a* so as to prevent back flow of the refrigerant inside the discharge chamber 15 through the discharge port 8*c*. Note that reference numeral 10 shown in FIG. 1 is a balancer, which is fixed to the shaft 1 or is engaged with the shaft 1 to be able to move slightly in the radial direction to enable adjustment of the offset of the crank part 1*a*.

Next, the structural portion of the first embodiment showing the characterizing features of the present invention will be explained. Reference numeral 6e shown in FIG. 1 and FIG. 2 is a ring-shaped groove formed in the back surface of the end plate 6*a* of the movable scroll 6. This faces the surface of a middle housing 13 around the center of the end plate 6*a* and forms a space serving as a ring-shaped backpressure chamber 19 with the surface by contact with it in a sliding state. Further, a pressure introduction port 6*d* is provided so as to connect the backpressure chamber 19 and a working chamber 9 formed at a predetermined position, so fluid (refrigerant) pressurized to a high-pressure of a predetermined level in the working chamber 9 is introduced to the backpressure chamber 19 and presses the end plate 6*a* of the movable scroll 6 toward the fixed scroll 8 using the middle housing 13 as footing. Note that in the first embodiment, the backpressure chamber 19 is formed as a single ring shape by the ring-shaped groove 6*e*, but of course it is also possible to form a plurality of these concentrically.

Corresponding to the characterizing portion of the present invention, in the case of the first embodiment, an inner and outer seal ring are provided separate from each other in the backpressure chamber 19. That is, an outer ring 11 of a closed ring shape is provided along the outer circumference of the ring-shaped groove 6*e* forming the backpressure chamber 19, while an inner seal ring 12 of a closed ring shape is formed along the inner circumference of the ring-shaped groove 6*e*. The seal rings 11 and 12 seal the clearance between the inner and outer wall surfaces of the backpressure chamber 19 in the radial direction of the end plate 6*a* of the movable scroll and the surfaces of the middle housing facing the same to prevent leakage of the refrigerant.

The portion most characteristic of the first embodiment is shown enlarged in FIG. 2. In the case of the first embodiment, the ring-shaped groove 6*e* formed in the end plate 6*a* of the movable scroll 6 forms the backpressure chamber 19 together with the surface of the middle housing 13, while the clearance between them is sealed by concentrically fitting an outer seal ring 11 having a step-shaped cross-section and an inner seal ring 12 having a step-shaped cross-section in the backpressure chamber 19. Both of the seal rings 11 and 12 are continuous ring shapes and do not have cut parts like the joint provided in a piston ring used in an internal combustion engine. The seal rings 11 and 12 may be formed by a material like rubber, plastic, or metal having wear resistance, oil resistance, and elasticity.

In the no-load state bore the seal rings 11 and 12 are fit in the backpressure chamber 19, the top surface 111 and bottom surface 112 of the outer ring 11 form parallel horizontal surfaces. The outer circumference 113 forms a tapered surface (conical surface). Further, the outer circumferential diameter ϕd1 of the bottom surface 112, which has the largest diameter of the outer seal ring 11, is set to be somewhat larger than the outer circumferential diameter ϕD1 of the bottom surface 191 of the backpressure chamber 19 comprised of the ring-shaped groove 6*e*. Therefore, if the outer seal ring 11 is pressed into the backpressure chamber 19 for fitting, the sectional shape of the outer seal ring 11 inclines (moves) slightly, so the edge-shaped projecting rim 115 formed in a ring at the outer circumference of the bottom surface 112 is pressed against the outer circumference corner 194 of the ring-shaped groove 6*e* where the cylindrically shaped outer circumference 192 and bottom surface 191 of the backpressure chamber 19 perpendicularly intersect. A ring-shaped portion of a higher contact pressure than its surroundings can be formed there (see FIG. 33).

Since the outer circumference 113 of the tapered outer seal ring 11 approaches the cylindrically shaped outer circumference 192 of the groove 6*e*, the cylindrically shaped inner circumference 114 of the outer seal ring 11 becomes a somewhat inclined taper. Due to this, the ring-shaped corner 116 near the inner circumference 114 in the top surface 111 of the outer seal ring 11 is pressed strongly against the surface of the middle housing 13 and therefore the contact pressure at the corner 116 becomes higher. By the sectional shape of the outer seal ring 11 inclining (moving) slightly, the contact pressure of the narrow width ring-shaped corner 116 near the inner circumference of the top surface 111 of the outer ring 11 and the narrow width ring-shaped portion close to the projecting rim 115 near the outer circumference of the bottom surface 112 becomes high, so the outer circumference side portion of the backpressure chamber 19 is sealed between the end plate 6*a* of the movable scroll 6 and the surface of the middle housing 13 supporting the same.

In this way, a ring-shaped higher contact pressure portion is formed by the slight incline of the sectional shape of the outer seal ring 11 in the backpressure chamber 19 (groove 16*e*). This action is further strengthened by the sectional shape inclining (moving) slightly and therefore the portion near the inner circumference of the bottom surface 112 rising up slightly from the bottom surface 191 of the groove 6*e*, high-pressure fluid invading the clearance and pressing the bottom surface 112 of the outer seal ring 11 up at the portion near the inner circumference and acting to increase the inclination angle of the sectional shape of the bottom surface 112 of the outer seal ring 11. Therefore, the larger the differential pressure between the backpressure chamber 19 and the suction chamber 14, the greater the sealing effect of the outer seal ring 11.

The inner seal ring 12 appears symmetric with the outer seal ring 11 in FIG. 2, but when fit inside the backpressure chamber 19 (ring-shaped groove 6*e*), the sectional shape of the inner seal ring 12 also inclines (moves) slightly in the backpressure chamber 19, whereby the inner circumference side portion of the backpressure chamber 19 is sealed between the end plate 6*a* of the movable scroll 6 and the surface of the middle housing 13. That is, in the no-load state before being fit in the backpressure chamber 19, the top surface 121 and bottom surface 122 of the inner seal ring 12 are parallel and the inner circumference 123 forms a tapered surface while the outer circumference 124 forms a cylindrical surface. The inner circumference ϕd2 of the bottom surface, which is the smallest in diameter, in the inner seal ring 12, becomes smaller than the inner circumference diameter ϕD2 of the inner circumference 193 of the ring-shaped groove 6*e*.

Figure 33:
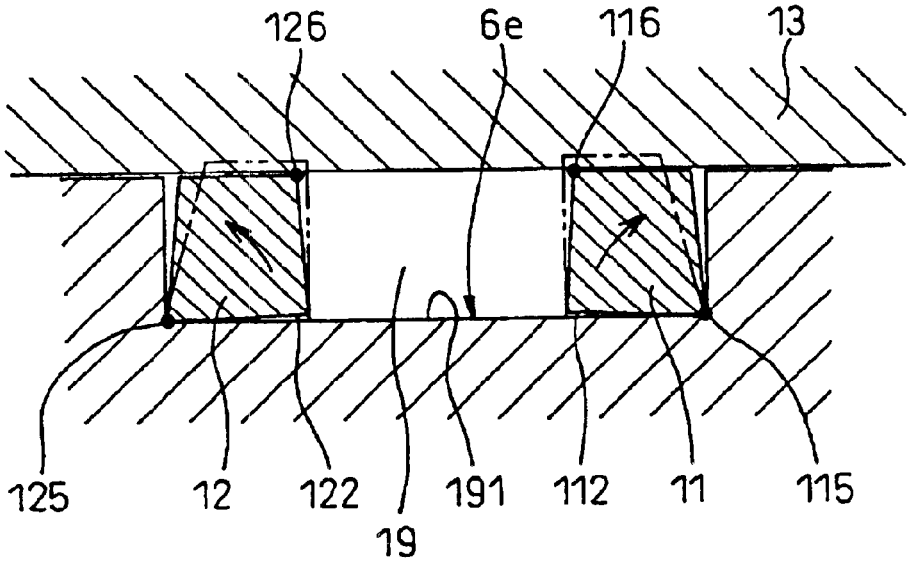
FIG. 33 is a sectional view of principal parts showing movement of a seal ring according to the first embodiment.

Therefore, if the inner seal ring 12 is expanded somewhat and fit into the ring-shaped groove 6*e*, the sectional shape of the inner seal ring 12 inclines (moves) slightly in the groove 6*e*, whereby the edge shaped projecting rim 125 formed in a ring shape at the inner circumference side of the bottom surface 122 and facing the inner circumference is strongly pressed against the ring-shaped inner circumference corner 195 where the bottom surface 191 and the cylindrically shaped inner circumference 193 of the groove 6 intersect and a portion of a narrow width and high contact pressure is formed in a ring shape (see FIG. 33). Further, the ring-shaped corner 126 near the outer circumference of the top surface 121 of the inner seal ring 12 is also pressed strongly against the surface of the middle housing 13, whereby a high contact pressure, narrow width ring-shaped region is formed. The action is strengthened by the difference in fluid pressure inside the backpressure chamber 19 and inside the suction chamber 14 in the same way as the outer seal ring 11.

Since the scroll compressor of the first embodiment has this structure, in an operating state where the movable scroll 6 is orbiting, a thrust load acts in the upward direction in FIG. 1 at the end plate 6*a* of the movable scroll 6 due to the differential pressure between the pressure of the refrigerant compressed in the plurality of crescent shaped working chambers 9 and the pressure in the suction chamber 14. Due to this thrust load caused by the compression reaction force, the end plate 6*a* is strongly pressed against the surface of the middle housing 13 and a large frictional force is generated with respect to the orbiting force of the movable scroll 6, but the fluid pressurized to a predetermined high-pressure is guided from the working chambers 9 through the pressure introduction port 6*d* into the backpressure chamber 19, so it is possible to cause the generation of a downward thrust force of the same magnitude as the upward thrust load by the difference between the pressure inside the backpressure chamber 19 and the pressure in the suction chamber 14. The two opposing direction thrust loads cancel each other out and therefore the contact force between the end plate 6*a* and the middle housing 13 and thereby the contact force between the end plate 6*a* and the middle housing 13 becomes exactly the load acting in the axial direction on the seal rings 11 and 12 due to the difference between the pressure of the backpressure chamber 19 and the pressure of the suction port 14.

Using the fluid pressure in the backpressure chamber 19 to cause the generation of a thrust force countering the pressure of the refrigerant compressed in the working chambers 9 was also a practice of the above related art, but the scroll compressor of the first embodiment uses two seal rings 11 and 12 having special sectional shapes. By the slight inclination (movement) of the sectional shapes of the seal rings 11 and 12 in the backpressure chamber 19, portions of a larger contact pressure are formed in ring shapes and a higher sealing effect exhibited. Therefore, it is possible to reliably prevent leakage of high-pressure fluid from the backpressure chamber 19 and the efficiency of the scroll compressor becomes higher.

Figure 3:
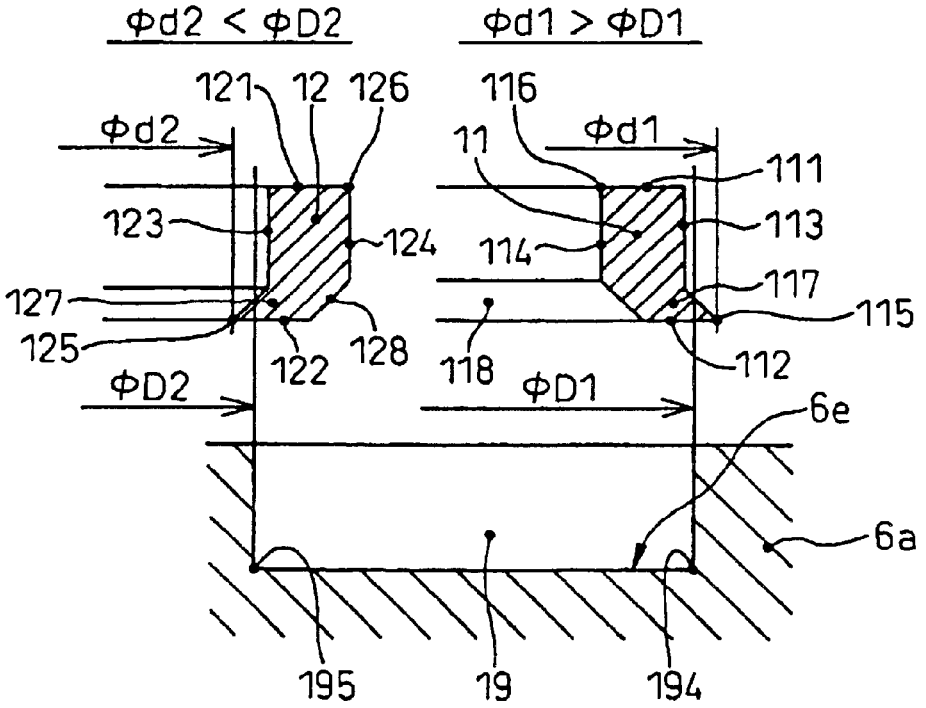
FIG. 3 is an enlarged sectional view of principal parts of a second embodiment.

FIG. 3 shows principal parts of a second embodiment of the present invention. The scroll compressors of the second embodiment to the 12th embodiment will be explained only for their principal configurations and their actions and effects. The overall non-characterizing configurations etc. will not be particularly explained, but the overall configurations of the embodiments etc. may be considered similar to corresponding portions of the first embodiment explained previously with reference to FIG. 1.

The outer seal ring 11 in the second embodiment forms a tapered surface at just part of its outer circumference 113 and forms a cylindrical surface at the other majority portion in the no-load state before being fit in the backpressure chamber 19. Therefore, the portion of the tapered shape including the ring-shaped projecting rim 115 forms the ring-shaped projection 117 facing outward in the radial direction. Of course, in the first embodiment shown in FIG. 2 as well, it is possible to see that the ring-shaped projection 117 is formed by the outer circumference 113 of the overall tapered surface. Note that in the second embodiment, the tapered surface 118 is formed at part of the cylindrically shaped inner circumference 114 as well. The rest of the configuration and the action and effects of the outer seal ring 11 are similar to the case of the first embodiment.

In the second embodiment as well, an inner seal ring 12 is provided separately from the outer seal ring 11. Part of the bottom part of the inner circumference 123 of the inner seal ring 12 of the second embodiment forms a tapered surface, whereby a ring-shaped projection 127 facing inward in the radial direction is formed. The front end of the projection 127 forms a ring-shaped projecting rim 125. Further, part of the bottom of the outer circumference 124 is also formed with a tapered surface 128. The action and effects of the inner seal ring 12 in the second embodiment are also the same as those of the first embodiment.

Figure 4:
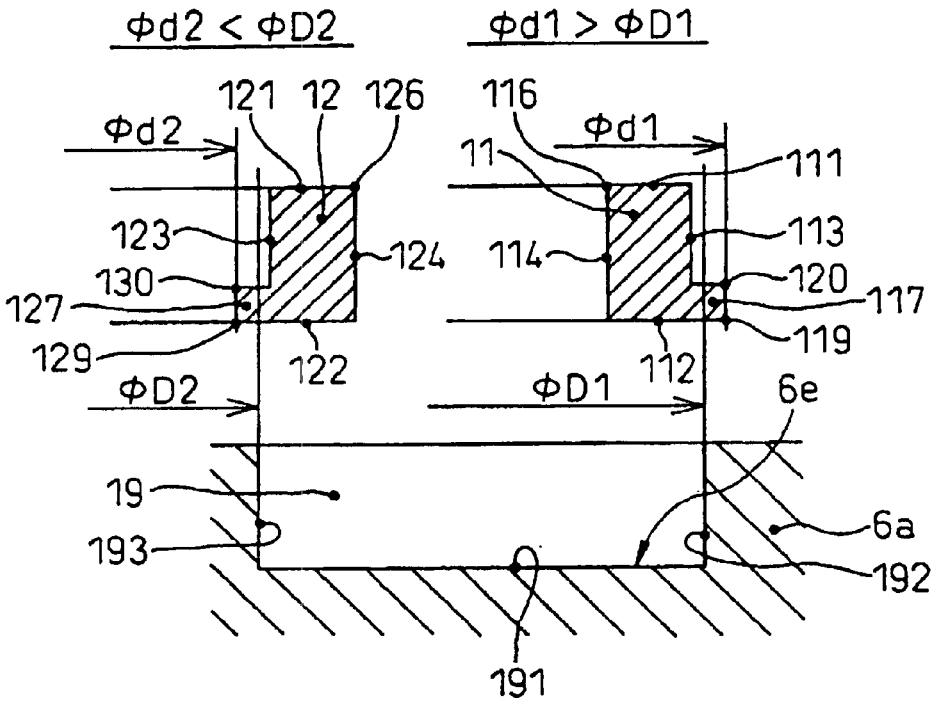
FIG. 4 is an enlarged sectional view of principal parts of a third embodiment.

FIG. 4 shows principal parts of a third embodiment of the present invention. Unlike the first embodiment or second embodiment, the outer circumference 113 of the outer seal ring 11 in the third embodiment is not provided with a tapered surface. The shape of the outer circumference 113 in the no-load state before being fit in the backpressure chamber 19 is mostly cylindrical. Only the portion close to the bottom surface 112 forms a ring-shaped projection 117 projecting outward in the radial direction. The sectional shape of the ring-shaped projection 117 is square or rectangular. Therefore, the sharp projecting rim 115 is not formed as in the second embodiment, but when the sectional shape slightly inclines, the two corners 119 and 120 of the ring-shaped projection 117 having the small square sectional shape etc. contact the bottom 191 of the ring-shaped groove 6*e* and the outer circumference 192 and form a higher contact pressure, narrow width ring-shaped contact region, so the corners 119 and 120 act in the same way as the projecting rim 115. Therefore, the outer seal ring 11 of the third embodiment exhibits substantially the same effects as in the case of the first embodiment.

The inner seal ring 12 of the third embodiment is also not provided with a tapered surface. In the same way as the outer seal ring 11, a ring-shaped projection 127 having a small square or rectangular sectional shape is provided so as to project inward in the radial direction. Due to this, the ring-shaped projection 127 of the inner seal ring 12 is also formed with the corners 129 and 130. When the sectional shape of the inner seal ring 12 inclines slightly, a higher contact pressure, narrow contact region is formed between the bottom surface 191 of the ring-shaped groove 6*e* and the inner circumference 193. Further, in this case as well, the embodiment exhibits substantially the same actions and effects as the inner seal ring 12 in the first embodiment, so the ring works with the outer seal ring 11 to prevent leakage of the fluid from the backpressure chamber 19 and improve the efficiency of the scroll compressor in the same way as the case of the previous embodiments.

Figure 5:
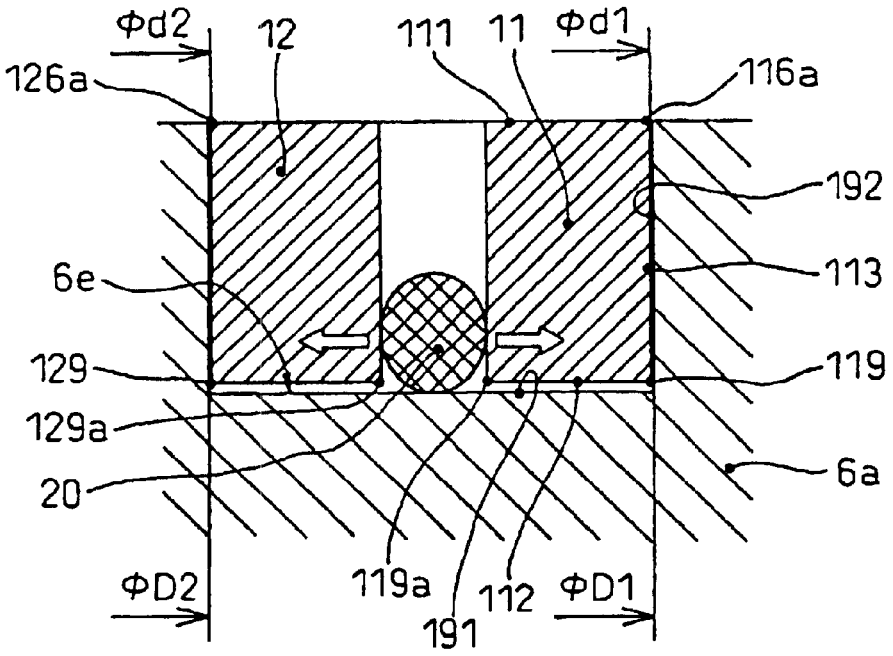
FIG. 5 is an enlarged sectional view of principal parts of a fourth embodiment.

FIG. 5 shows principal parts of a fourth embodiment of the present invention. The characterizing features of the fourth embodiment are that use is made of two seal rings 11 and 12 having rectangular (or square) sectional shapes in the no-load state before being fit in the backpressure chamber 19 and the attachment of a ring-shaped elastic member 20 comprised of rubber or a coil spring etc. at a position near the bottom surface 191 of the backpressure chamber 19 (ring-shaped groove 6*e*) even in the clearance formed between the seal rings 11 and 12. Note that in this case as well, the outer circumferential diameter ϕd1 of the outer seal ring 11 in the no-load state before being fit in the backpressure chamber 19 is set larger than the outer circumferential diameter ϕD1 of the ring-shaped groove 6*e*, while the inner circumferential diameter ϕd2 of the inner seal ring 12 is set smaller than the inner circumferential diameter ϕD2 of the ring-shaped groove 6*e*.

In the fourth embodiment, the two seal rings 11 and 12 are not provided with the ring-shaped projection 117 or 127 as in the above embodiments, but the ring-shaped elastic member 20 attached between them presses the bottoms of the seal rings 11 and 12 in the side directions as shown by the arrows, so these incline in the opposite directions to the case of the above embodiments. Due to this, the corner 119 of the outer seal ring 11 is strongly pressed against the outer circumference 192 of the ring-shaped groove 6*e* and forms a high contact pressure, narrow width ring-shaped contact region. Further, in the top surface 111, the corner 116*a* near the outer circumference is pressed against the surface of the middle housing 13 and forms a high contact pressure, narrow width contact region there. Further, when the corner 119*a* near the inner circumference at the bottom surface 112 of the outer seal ring 11 contacts the bottom surface 191 of the groove 6*e*, a high contact pressure, narrow width ring-shaped contact region is formed there.

In this way, the outer seal ring 11 of the fourth embodiment exhibits a high sealing effect similar to that of the first embodiment. As clear from the explanation of the outer seal ring 11, it is possible for the corners 129 and 126*a* and in some cases the corner 129*a* as well to form higher contact pressure, narrow width ring-shaped contact regions in the inner seal ring 12 in the fourth embodiment as well and thereby give a higher sealing effect. Note that in the fourth embodiment, needless to say generally the same action and effects can be obtained even if using the seal rings 11 and 12 in the above embodiments instead of the rectangular cross-section seal rings 11 and 12.

Figure 6:
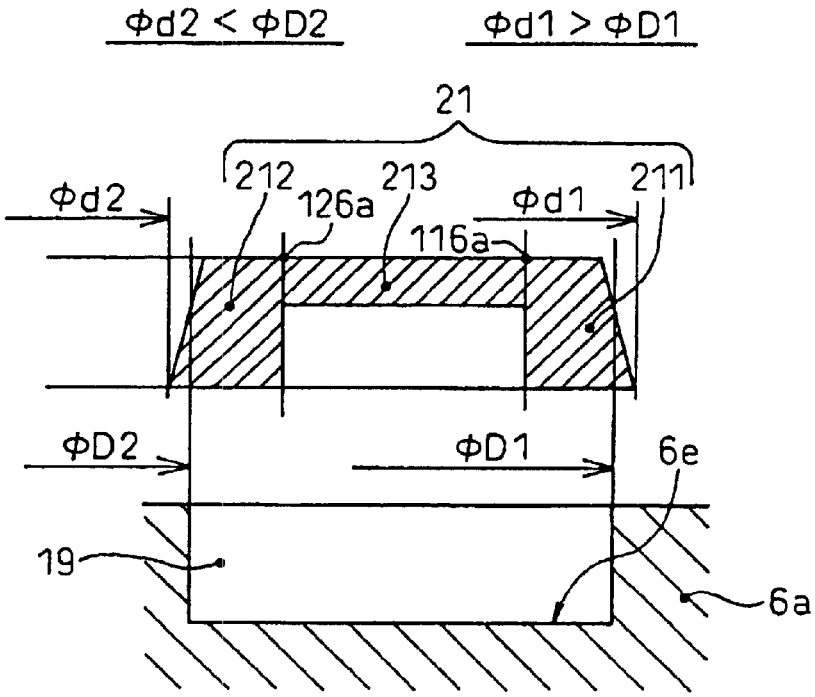
FIG. 6 is an enlarged sectional view of principal parts of a fifth embodiment.

FIG. 6 shows principal parts of a fifth embodiment of the present invention. From the first embodiment to the fourth embodiment, the case of two independent seal rings 11 and 12 was explained, but in the fifth embodiment to the 12th embodiment, a single seal ring comprised of parts corresponding to the two seal rings 11 and 12 connected by a common connecting portion is used. In the case of the fifth embodiment, the integral seal ring 21 is comprised of a ring-shaped outer seal ring part 11 having a sectional shape resembling the outer seal ring 11 in the first embodiment, a ring-shaped inner seal ring part 212 having a sectional shape resembling the inner ring 12, and a ring-shaped connecting part connecting the two. The relative dimensions of the ring-shaped groove 6*e* and sealing ring 21 are similar to the case of the first embodiment. The means for introducing the high-pressure fluid into the backpressure chamber 19 (ring-shaped groove 6*e*) is use of the pressure introduction hole 6*d* shown in FIG. 1.

The seal ring 21 of the fifth embodiment forms a U-shape overall. Part of the connecting part 213 contacts the surface of the opposing middle housing 13, so the connecting part 213 exhibits a sealing effect. Further, the outer seal ring part 211 and the inner seal ring part 212 are connected by the connecting part 213 to form the single seal ring, so the fifth embodiment has the advantages of a smaller number of parts and easier assembly. In other respects, this embodiment exhibits actions and effects similar to the case of the first embodiment. The seal ring parts 211 and 212 of the fifth embodiment, however, do not have the corners 116 and 126 shown in FIG. 2, so the top surfaces 116*a* and 126*a* of the connecting part of the seal ring parts 211 and 212 are strongly pressed against the surface of the middle housing 13 and a high contact pressure, narrow width ring-shaped contact region is formed.

Figure 7:
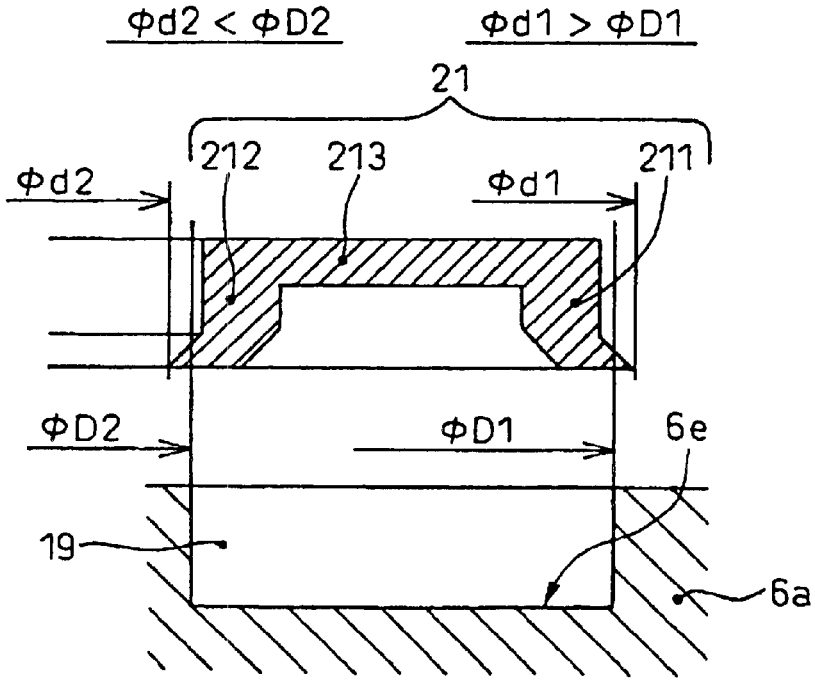
FIG. 7 is an enlarged sectional view of principal parts of a sixth embodiment.

FIG. 7 shows principal parts of a sixth embodiment of the present invention. In the same way as the fifth embodiment corresponding to the first embodiment, the sixth embodiment corresponds to the second embodiment shown in FIG. 3. The configuration and action of the sixth embodiment are clear as seen from FIG. 7 while referring to the explanations of the fifth embodiment and second embodiment, so a detailed explanation will be omitted here. The sixth embodiment exhibits substantially the same effects as the first embodiment.

Figure 8:
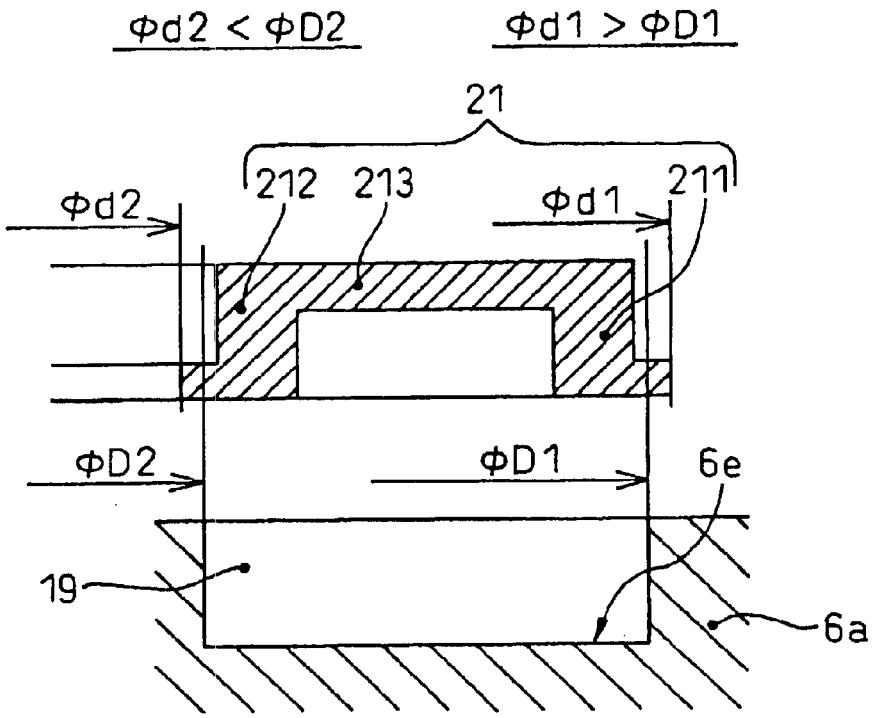
FIG. 8 is an enlarged sectional view of principal parts of a seventh embodiment.

FIG. 8 shows principal parts of a seventh embodiment of the present invention. In the same way as the fifth embodiment corresponding to the first embodiment, the seventh embodiment corresponds to the third embodiment shown in FIG. 4. The configuration and action of the seventh embodiment are clear as seen from FIG. 8 while referring to the explanations of the fifth embodiment and third embodiment, so a detailed explanation will be omitted here. The seventh embodiment exhibits substantially the same effects as the first embodiment.

Figure 9:
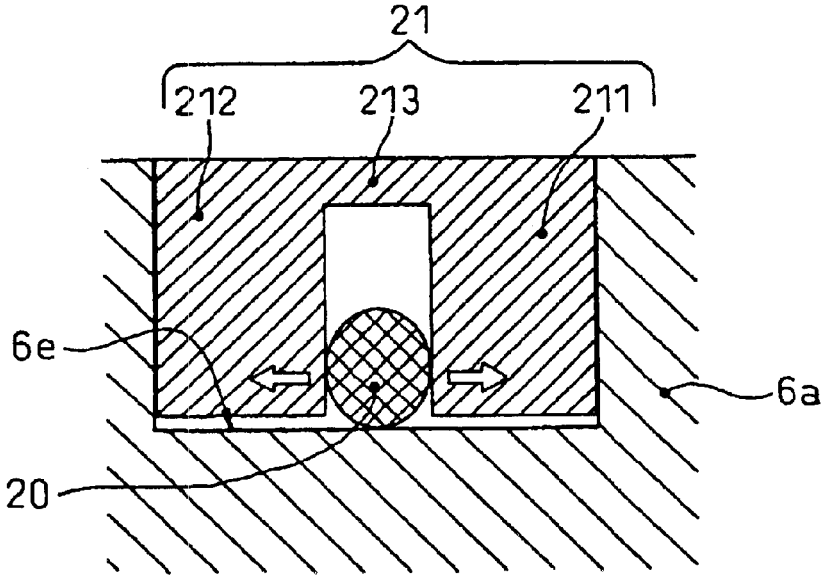
FIG. 9 is an enlarged sectional view of principal parts of an eighth embodiment.

FIG. 9 shows principal parts of an eighth embodiment of the present invention. In the same way as the fifth embodiment corresponding to the first embodiment, the eighth embodiment corresponds to the fourth embodiment shown in FIG. 5. The configuration and action of the eighth embodiment are clear as seen from FIG. 9 while referring to the explanations of the fifth embodiment and fourth embodiment, so a detailed explanation will be omitted here. The eighth embodiment exhibits substantially the same effects as the first embodiment.

Figure 10:
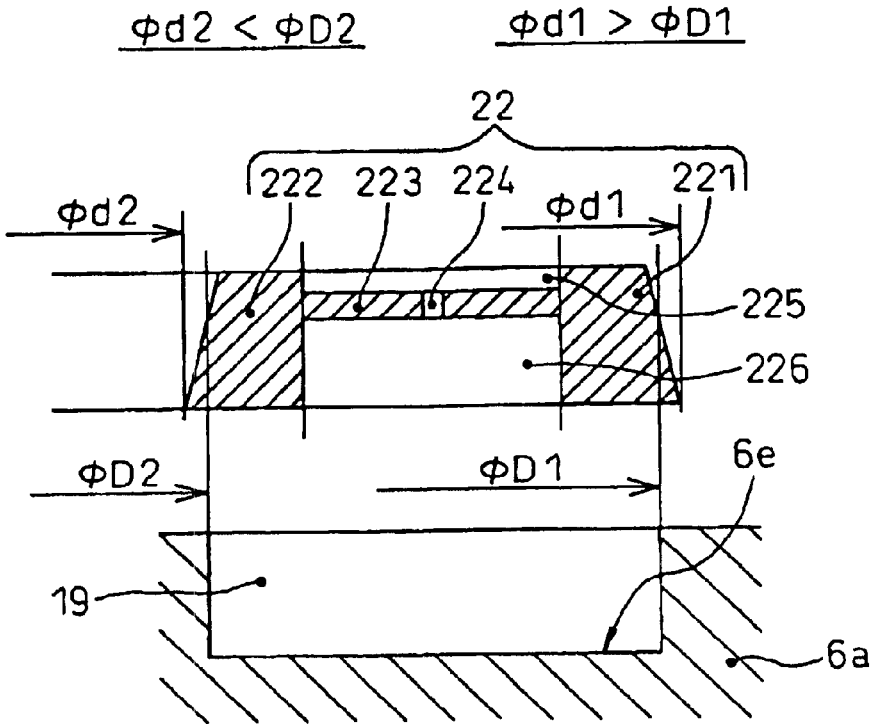
FIG. 10 is an enlarged sectional view of principal parts of a ninth embodiment.

FIG. 10 shows principal parts of a ninth embodiment of the present invention. In the ninth embodiment, in the same way as the sealing ring 21 from the fifth embodiment to the eighth embodiment, a seal ring 22 of a type comprised of parts corresponding to the two seal rings 11 and 12 in the first embodiment etc. connected by a common connecting part is used. As clear from the fact that the seal ring 22 has an H-shaped cross-section, however, the connecting part 223 connecting the outer seal ring part 221 and the inner seal ring part 222 of the seal ring 22 does not contact the surface of the middle housing 13 directly, so the connecting part 223 does not exhibit a substantive sealing action.

The connecting part 223 of the seal ring 22 is provided with one or more communicating holes 224, which connect the upper space 225 and lower space 226 formed inside the ring-shaped groove 6*e*. The relative dimensions of the ring-shaped groove 6*e* and the seal ring 22 are similar to those of the case of the first embodiment. The means for introducing the high-pressure fluid into the backpressure chamber 19 (spaces 225 and 226) may be something like the pressure introduction port 6*d* shown in FIG. 1 for example. Part of the high-pressure fluid introduced into the lower space 226 passes through the communicating holes 224 of the connecting part 223 and sneaks into the upper space 225. Due to this, the outer seal ring part 221 and inner seal ring part 222 of the seal ring 22 in the ninth embodiment can exhibit substantially the same action as the two seal rings 11 and 12 in the first embodiment.

The characterizing feature of the ninth embodiment over the fifth embodiment (FIG. 6) lies in the point that the connecting part 223 does not contact the surface of the facing middle housing 13 and therefore the contact area becomes smaller and the mechanical loss can be reduced. Further, the characterizing feature over the first embodiment (FIG. 2) lies in the point that the outer seal ring part 221 and the inner seal part 222 are connected by the connecting part 222, so the number of parts becomes smaller by that amount and the attachment of the seal ring becomes easier.

Figure 11:
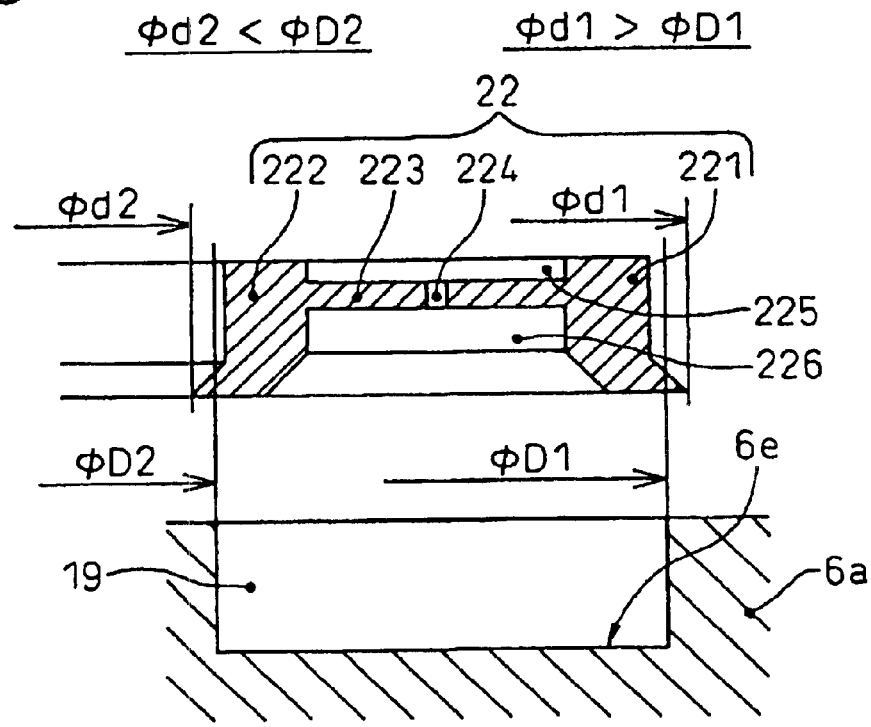
FIG. 11 is an enlarged sectional view of principal parts of a 10th embodiment.

FIG. 11 shows principal parts of a 10th embodiment of the present invention. In the same way as the ninth embodiment corresponding to the first embodiment shown in FIG. 2, the 10th embodiment corresponds to the second embodiment shown in FIG. 3. The configuration and action of the 10th embodiment are clear as seen from FIG. 11 while referring to the explanations of the ninth embodiment and second embodiment, so a detailed explanation will be omitted here. The 10th embodiment exhibits substantially the same effects as the ninth embodiment and first embodiment.

Figure 12:
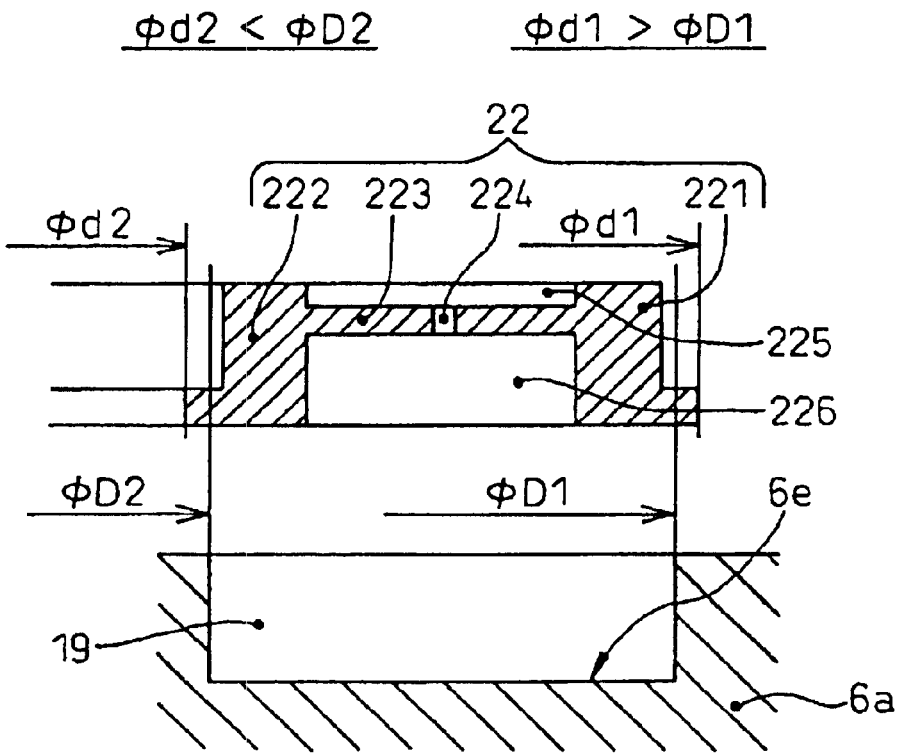
FIG. 12 is an enlarged sectional view of principal parts of an 11th embodiment.

FIG. 12 shows principal parts of an 11th embodiment of the present invention. In the same way as the ninth embodiment corresponding to the first embodiment shown in FIG. 2, the 11th embodiment corresponds to the third embodiment shown in FIG. 4. The configuration and action of the 11th embodiment are clear as seen from FIG. 12 while referring to the explanations of the ninth embodiment and third embodiment, so a detailed explanation will be omitted here. The 11th embodiment exhibits substantially the same effects as the ninth embodiment and first embodiment.

Figure 13:
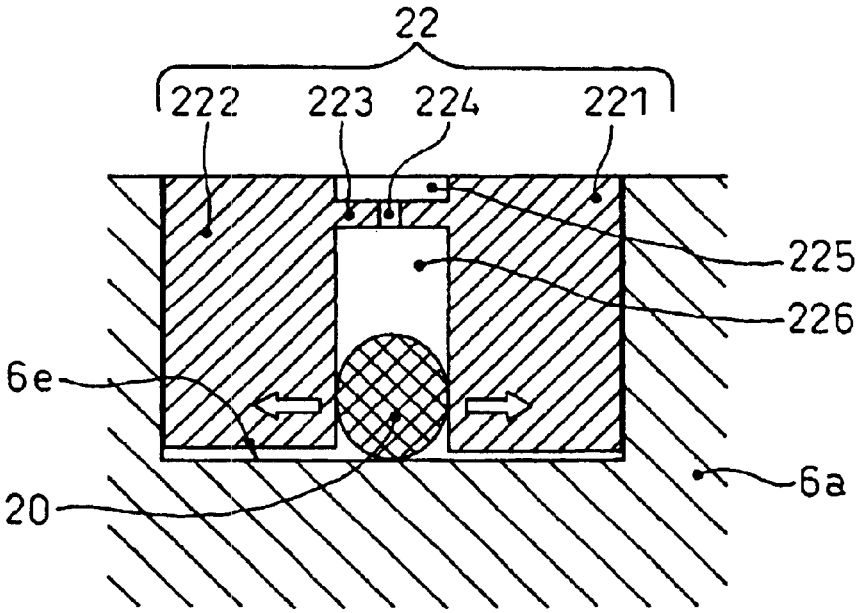
FIG. 13 is an enlarged sectional view of principal parts of a 12th embodiment.

FIG. 13 shows principal parts of a 12th embodiment of the present invention. In the same way as the ninth embodiment corresponding to the first embodiment shown in FIG. 2, the 12th embodiment corresponds to the fourth embodiment shown in FIG. 5. The configuration and action of the 12th embodiment are clear as seen from FIG. 13 while referring to the explanations of the ninth embodiment and fourth embodiment, so a detailed explanation will be omitted here. The 12th embodiment exhibits substantially the same effects as the ninth embodiment and first embodiment.

Figure 14:
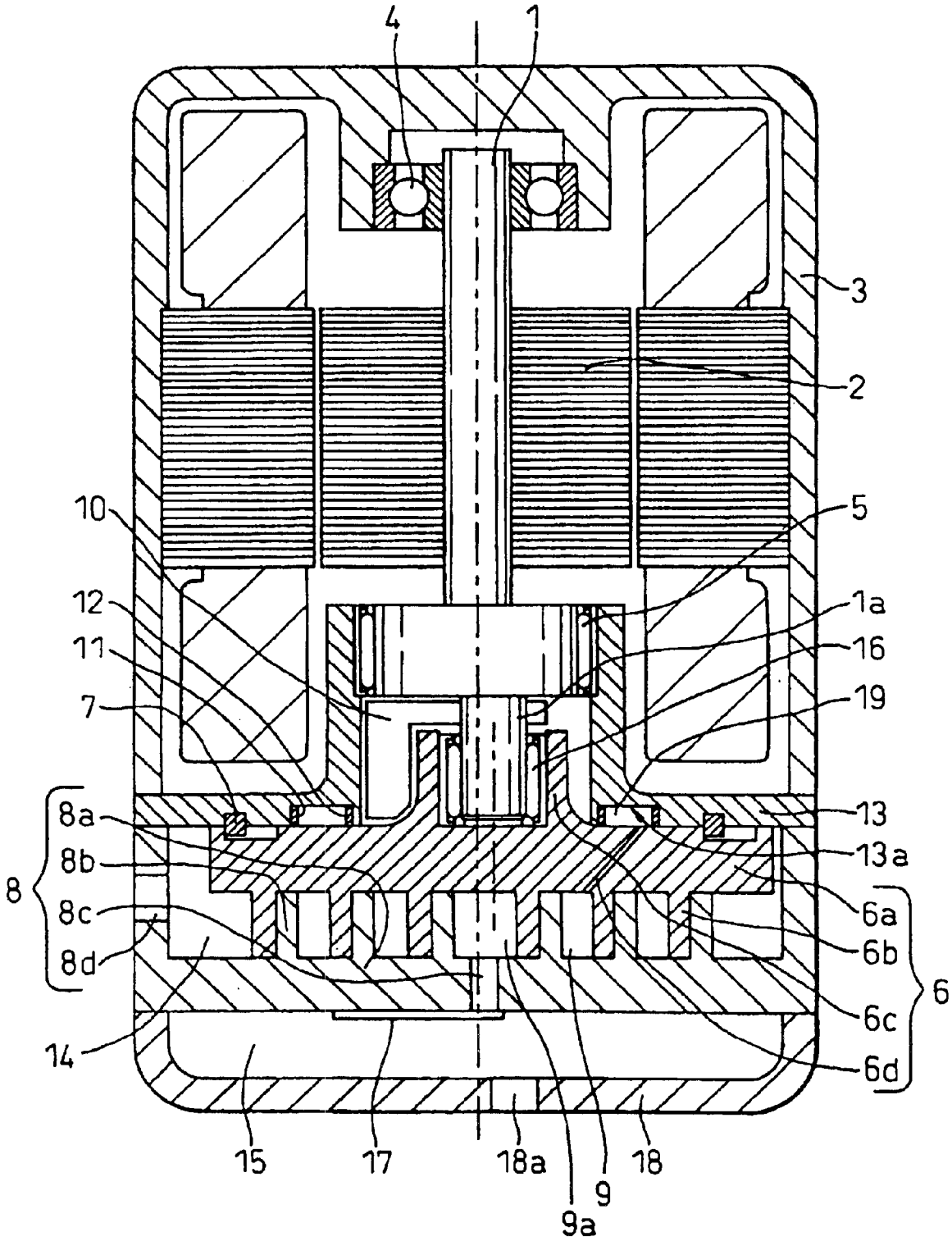
FIG. 14 is a longitudinal sectional view of a 13th embodiment of the present invention.

Next, FIG. 14 shows a scroll compressor according to a 13th embodiment of the present invention. Portions common with the scroll compressor of the first embodiment shown in FIG. 1 and FIG. 2 are assigned the same reference numerals and overlapping explanations are omitted. The characterizing feature of the compressor of the 13th embodiment lies in the point that backpressure chamber 19 which had been formed by the ring-shaped groove 6*e* formed in the end plate 6*a* of the movable scroll 6 in the compressor of the first embodiment is formed by a ring-shaped groove 13*a* formed in the middle housing 13 side. Therefore, the corresponding portion at the end plate 6*a* of the movable scroll 6 is flat. In the 13th embodiment as well, however, two seal rings 11 and 12 are fit in the ring-shaped groove 13*a* etc. in the same way as the case of the first embodiment. The actions and effects of the 13th embodiment are also the same as those of the first embodiment.

As clear from the fact that the 13th embodiment shown in FIG. 14 is equivalent to the first embodiment shown in FIG. 1 and FIG. 2, the backpressure chamber 19 can be formed by a ring-shaped groove 13*a* formed in the middle housing 13 side in the embodiments from the second embodiment shown in FIG. 3 to the 12th embodiment shown in FIG. 13 as well. The same actions and effects are obtained by this needless to say.

Figure 15:
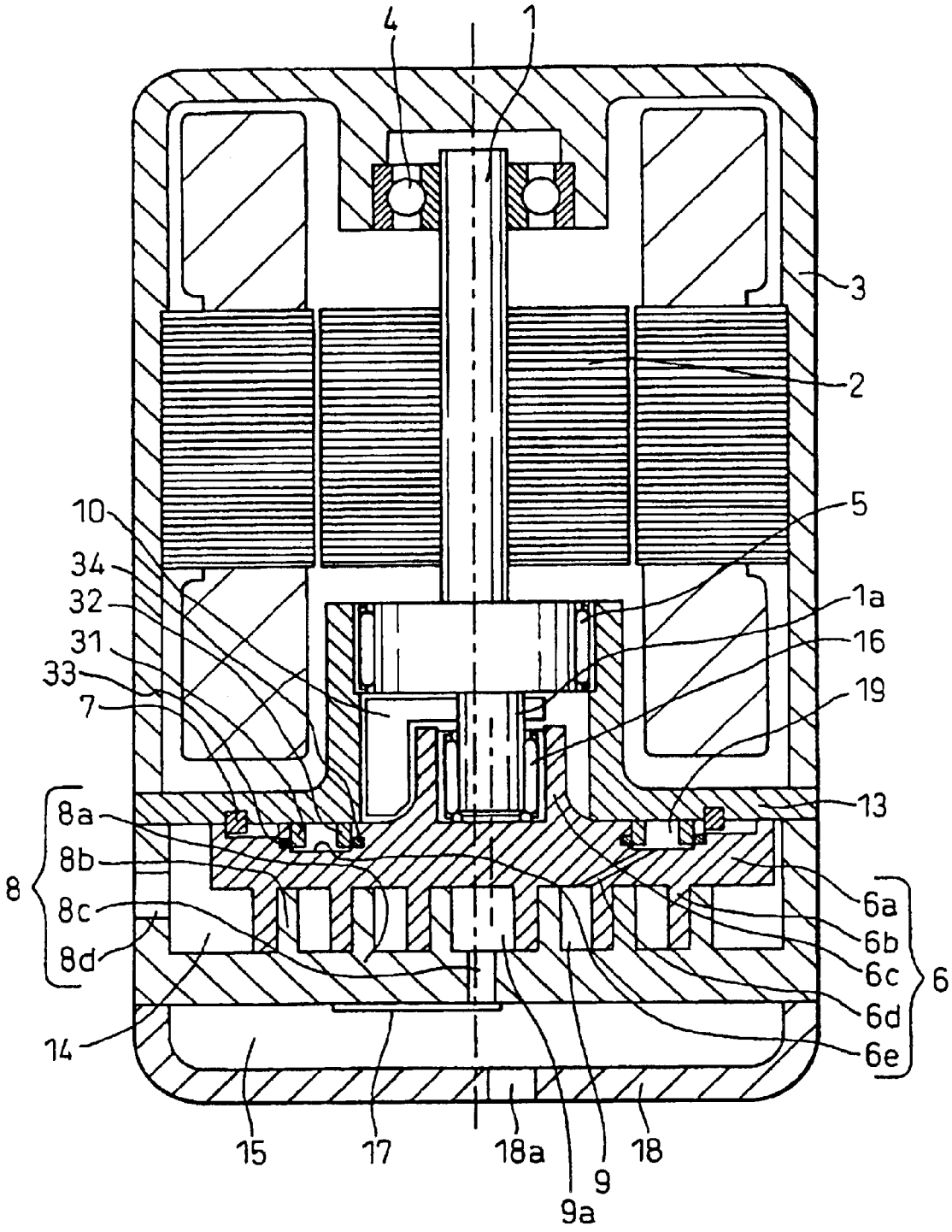
FIG. 15 is a longitudinal sectional view of a 14th embodiment of the present invention.

FIG. 15 shows a scroll compressor according to a 14th embodiment of the present invention. In the scroll compressors of the first embodiment to the 13th embodiment explained above, it was required that the principal parts of those embodiments, that is, the outer seal ring 11 and inner seal ring 12 etc., be able to at least incline slightly in sectional shape due to elastic deformation etc. in the backpressure chamber 19, but the outer seal rings and inner seal rings in the embodiments from the 14th embodiment on explained next do not have to incline in sectional shape in the backpressure chamber 19. Of course, this does not mean that these do not elastically deform at all, but depending on the material, when elastically deforming even a bit, similar effects are obtained as in the above embodiments. In the embodiments from the 14th embodiment on, however, separate additional seal means are provided, so inclination of the sectional shape by the elastic deforming of the seal rings is not an essential requirement.

The outer seal ring and inner seal ring in the embodiments from the 14th embodiment on may be made of a material having a small coefficient of friction and high wear resistance such as carbon, metal, ceramic, or other inorganic material or a plastic or powders or fibers of the same bound by a suitable binder etc. As examples of the specific material, a solid material comprised of at least 80% carbon impregnated with metallic antimony is particularly preferable in that it exhibits a superior self-lubricating action. This material has a Young's modulus from 10 to 25 GPa and a hardness of an extremely hard Shore's hardness of 50 to 100 or so, so does not elastically deform much at all. Further, it is possible to use polyether ether ketone (PEEK), polyphenylene sulfide (PPS), or various fluororesins or other plastic materials.

The basic configuration and operation of the scroll compressor of the 14th embodiment shown in FIG. 15 are the same as those of the first embodiment shown in FIG. 1. Therefore, components the same as those in the first embodiment are assigned the same reference numerals and overlapping explanations are omitted. The characterizing features of the embodiments from the 14th embodiment on lie in the provision of an outer seal ring 31 and inner seal ring 32 comprised of materials having a small coefficient of friction and high wear resistance as illustrated previously at the backpressure chamber 19 provided in the end plate 6*a* of the movable scroll 6 or middle housing 13 and in the addition of elastic seal members such as an outer O-ring 33 and inner O-ring 34 for the same.

Figure 16:
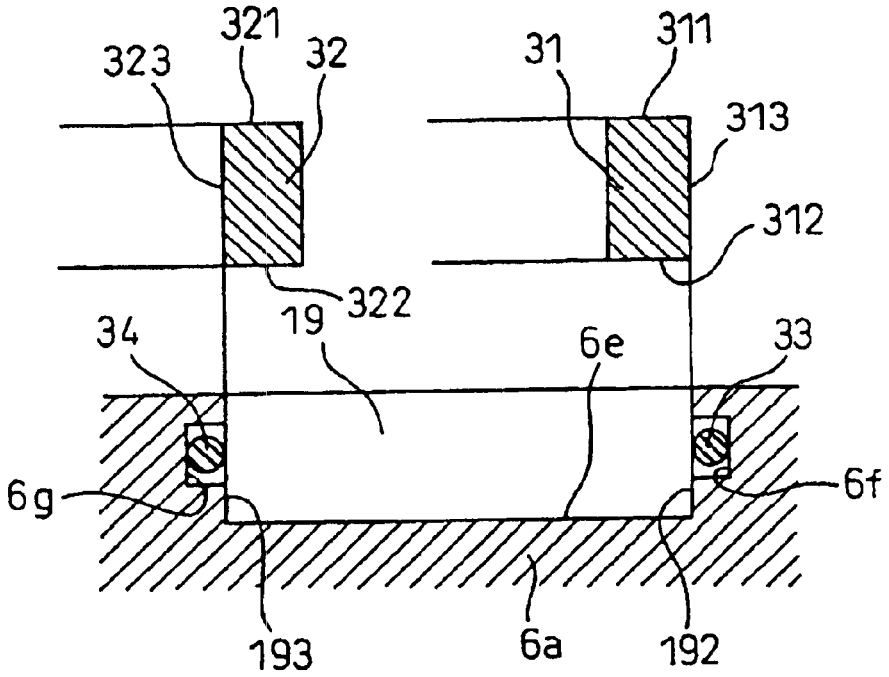
FIG. 16 is an enlarged sectional view of principal parts of the 14th embodiment.
Figure 34:
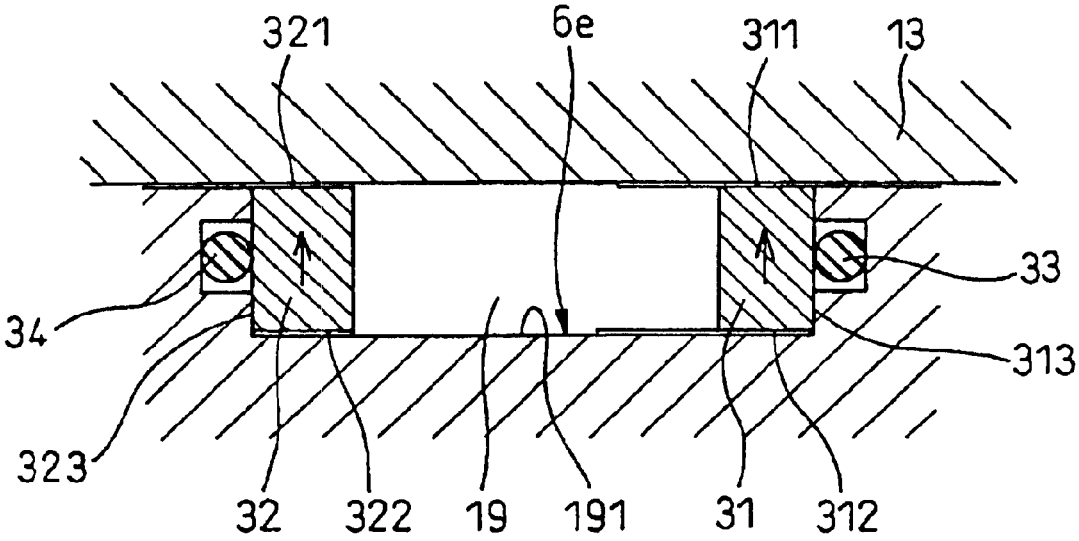
FIG. 34 is a sectional view of principal parts showing movement of a seal ring according to the 14th embodiment.

Principal parts of the 14th embodiment are shown enlarged in FIG. 16. The outer seal ring 31 and inner seal ring 32 used in the 14th embodiment are both rectangular in sectional shape. Needless to say, the "rectangular shape" in this case includes a square shape. As explained above, these are members substantially not elastically deforming and comprised of carbon etc. having a low coefficient of friction and high wear resistance. Therefore, when a fluid such as a refrigerant supplied to the backpressure chamber 19 acts on the bottom surfaces 312 and 322 of the outer seal ring 31 and inner seal ring 32, the outer seal ring 31 and the inner seal ring 32 are pushed up (move), so the top surfaces 311 and 321 contact the surface of the middle housing 13 in a strongly pressed state (see FIG. 34). A slight frictional sliding action occurs between the contact surfaces due to the orbiting motion of the movable scroll 6, but since the contact pressure at the contact surfaces is high, the fluid inside the backpressure chamber 19 is sealed and prevented from leaking to the outside.

Since the outer seal ring 31 and inner seal ring 32 do not elastically deform, however, fluid may leak from their side surfaces. Therefore, in the 14th embodiment, the outer circumference 192 of the ring-shaped groove 6*e* forming the backpressure chamber 19 is formed with a ring-shaped outer O-ring groove 6*f*. An oil resistant rubber outer O-ring 33 is fit there and made to contact the outer circumference 313 of the outer seal ring 31. Further, the inner circumference 193 of the groove 6*e* is formed with a ring-shaped inner O-ring groove 6*g*. An oil resistant rubber inner O-ring 34 is fit there and made to contact the inner circumference 323 of the inner seal ring 32. Since the side surfaces of the outer seal ring 31 and inner seal ring 32 are sealed by providing the outer O-ring 33 and inner O-ring 34, leakage of the pressurized fluid in the backpressure chamber 19 to the outside is prevented and the thrust load acting on the movable scroll 6 can be efficiently supported by the backpressure chamber 19.

Figure 17:
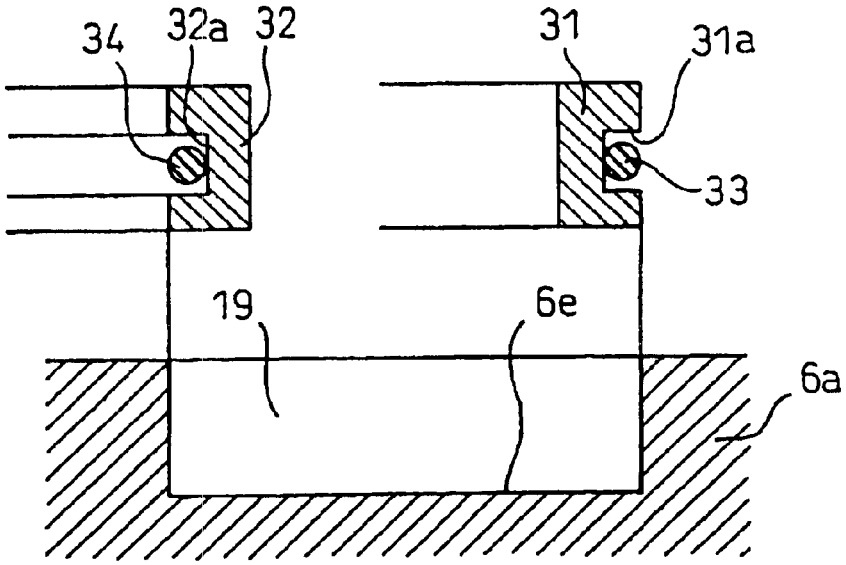
FIG. 17 is an enlarged sectional view of principal parts of a 15th embodiment.

Principal parts of a 15th embodiment of the present invention of a modification of the 14th embodiment are shown in FIG. 17. In this case, the outer circumference of the outer seal ring 31 is formed with a ring-shaped outer O-ring groove 31*a* and supports an outer O-ring 33. Further, the inner circumference of the inner seal ring 32 is formed with a ring-shaped inner O-ring groove 32*a* and supports an inner O-ring 34. The fact that this embodiment exhibits similar effects to the 14th embodiment is not believed to require explanation.

Figure 18:
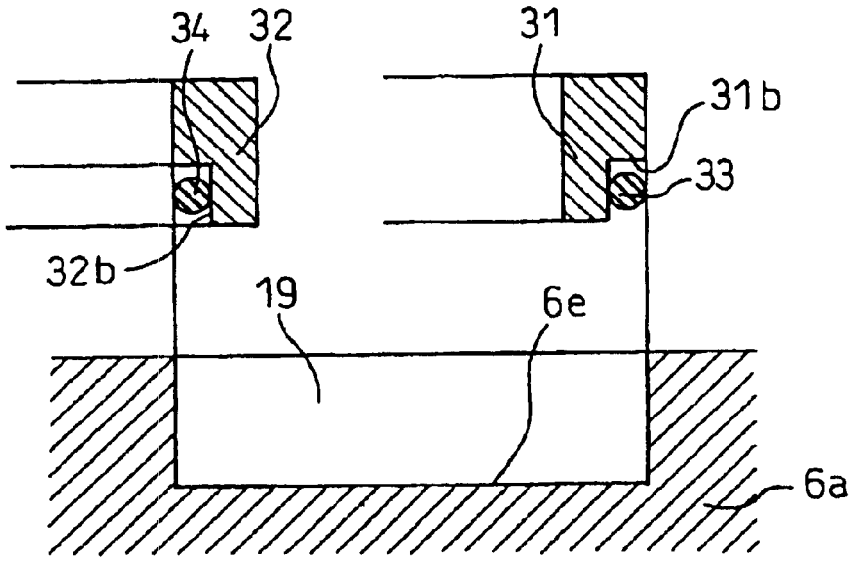
FIG. 18 is an enlarged sectional view of principal parts of a 16th embodiment.

Principal parts of a 16th embodiment of the present invention of another modification of the 14th embodiment are shown in FIG. 18. In this case, the bottom rim of the outer circumference of the outer seal ring 31 is formed with an outer O-ring groove 31*b* comprised of a ring-shaped cutout portion and supports an outer O-ring 33. Further, the bottom rim of the inner circumference of the inner seal ring 32 is formed with an inner O-ring groove 32*b* and supports an inner O-ring 34. The fact that this embodiment also exhibits similar effects to the 14th embodiment is not believed to require explanation.

Figure 19:
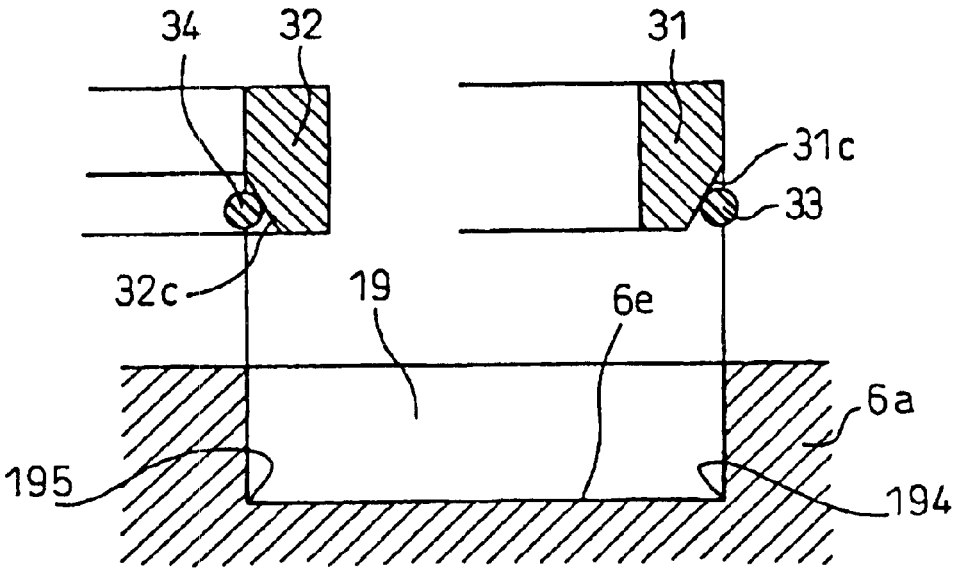
FIG. 19 is an enlarged sectional view of principal parts of a 17th embodiment.

Principal parts of a 17th embodiment of the present invention of a modification of the 14th embodiment are shown in FIG. 19. In this case, the bottom rim of the outer circumference of the outer seal ring 31 is formed with a ring-shaped outer O-ring support 31*c* comprised of a tapered cutaway portion. An outer O-ring 33 is supported between this and the outer circumference corner 194 of the ring-shaped groove 6*e* facing it. Further, the bottom rim of the inner circumference of the inner seal ring 32 is formed with a ring-shaped O-ring support 32*c* comprised of a tapered cutaway portion. An inner O-ring 34 is supported between this and the inner circumference corner 194 of the ring-shaped groove 6*e* facing it. This embodiment exhibits effects similar to the 16th embodiment and therefore similar to the 14th embodiment.

Figure 20:
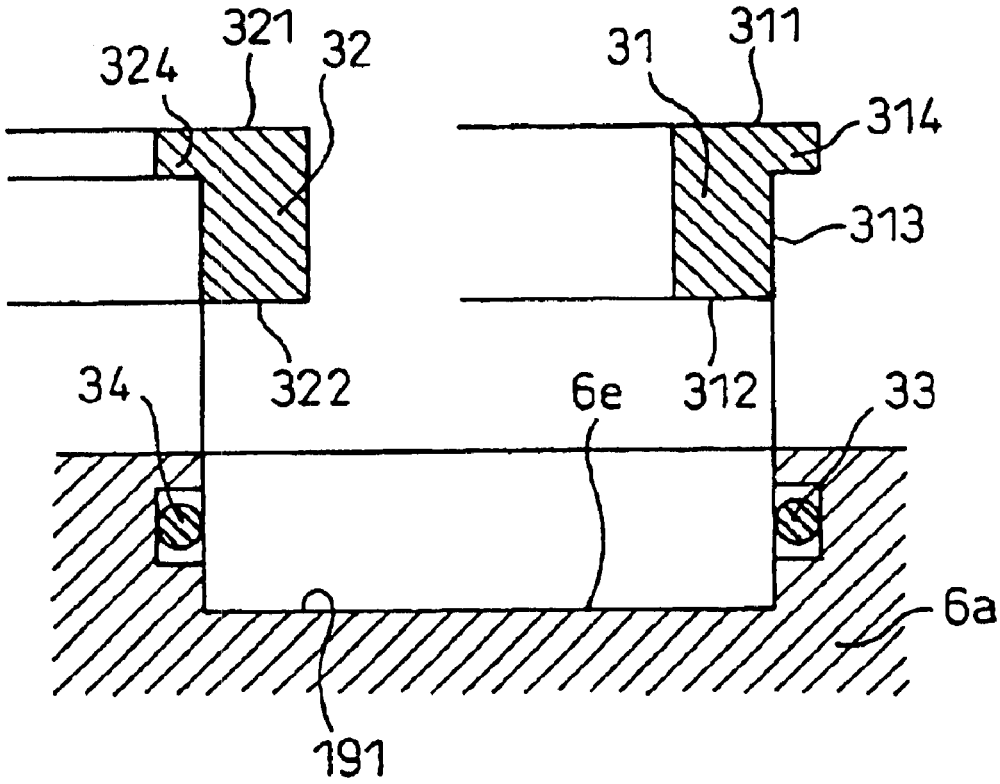
FIG. 20 is an enlarged sectional view of principal parts of an 18th embodiment.

FIG. 20 shows principal parts of an 18th embodiment of the present invention. There are many points in common compared with the principal parts of the 14th embodiment shown in FIG. 16. The characterizing features of the 18th embodiment over the 14th embodiment lie in the formation of the ring-shaped flange 314 projecting outward at the top end of the outer circumference 313 of the outer seal ring 31 and similarly the formation of the ring-shaped flange 324 projecting inward at the top end of the inner seal ring 32.

These ring-shaped flanges 314 and 324 increase the areas of the top surfaces 311 and 321 of the outer seal ring 31 and the inner seal ring 32, so improve the sealing performance of the seal rings and reduces the seal contact pressure, so can reduce wear at the seal surfaces and improve reliability and can also reduce the dynamic loss due to the sliding friction.

Figure 35:
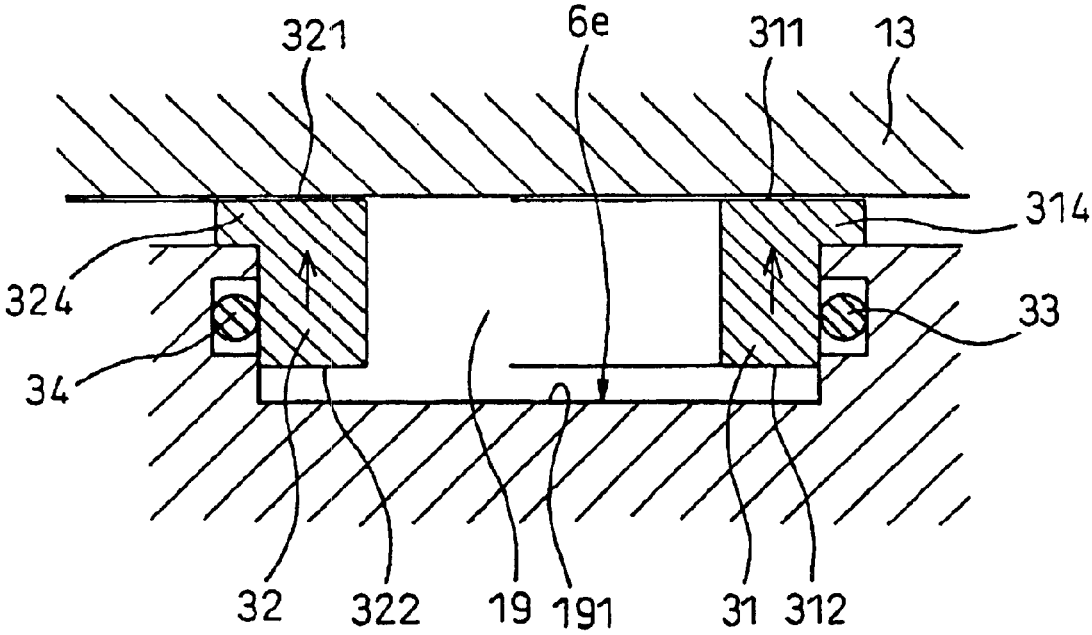
FIG. 35 is a sectional view of principal parts showing movement of a seal ring according to the 18th embodiment.

Further, these ring-shaped flanges 314 and 324 prevent the outer seal ring 31 and the inner seal ring 32 from completely falling into the ring-shaped groove 6*e* forming the backpressure chamber 19 and form clearances of a predetermined size between the bottom surface 191 of the backpressure chamber 19 and the bottom surfaces 312 and 322 of the outer seal ring 31 and the inner seal ring 32. Therefore, the pressure of the fluid supplied to the backpressure chamber 19 reliably acts on the bottom surfaces 312 and 322 of the outer seal ring 31 and inner seal ring 32 and pushes them up to cause movement to the contact position with the surface of the middle housing 31 (see FIG. 35), so the sealing actions of the outer seal ring 31 and inner seal ring 32 are sufficiently exhibited.

The flanges provided to increase the area of the sliding surfaces at the ends of the seal rings and reduce the contact pressure or to prevent the outer seal ring 31 or the inner seal ring 32 from completely falling into the backpressure chamber 19 are not limited to the 18th embodiment and may also be provided in the other embodiments.

Figure 21:
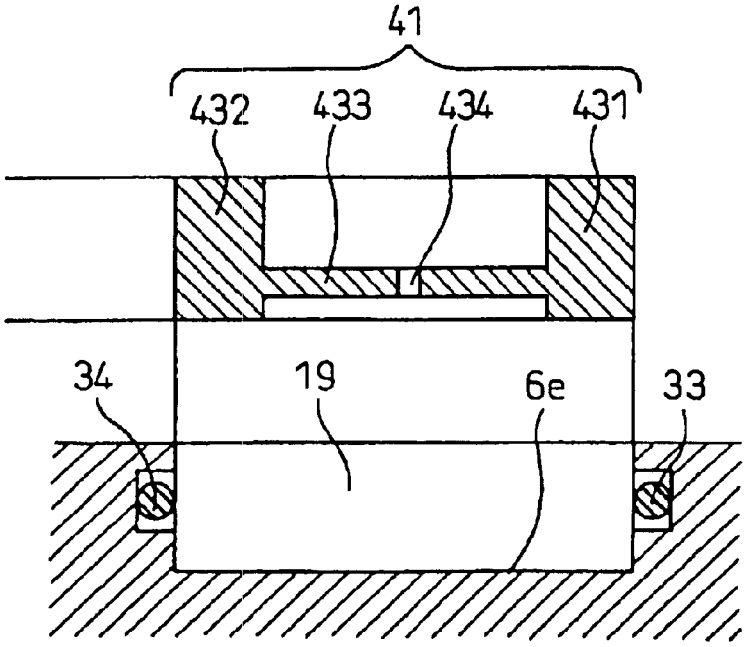
FIG. 21 is an enlarged sectional view of principal parts of a 19th embodiment.

FIG. 21 shows principal parts of a 19th embodiment of the present invention. The characterizing feature of the 19th embodiment, like the ninth embodiment (FIG. 10) etc., is the use of a seal ring 41 of a type comprised of two seal ring parts 431 and 432 corresponding to the two seal rings 31 and 32 in the 14th embodiment (FIG. 16) connected integrally by a common connecting portion 433. The connecting part 433 of the seal ring 41 is provided with one or more communicating holes 434 for communicating the upper space and lower space formed inside the ring-shaped groove 6*e* and forming a common backpressure chamber 19. Due to this, the outer seal ring part 431 and inner seal ring part 432 of the seal ring 41 in the 19th embodiment can exhibit actions substantially the same as the two seal rings 31 and 32 in the 14th embodiment. Since the two seal ring parts 431 and 432 are connected integrally by the connecting part 433, the number of parts is reduced and assembly is facilitated.

Figure 22:
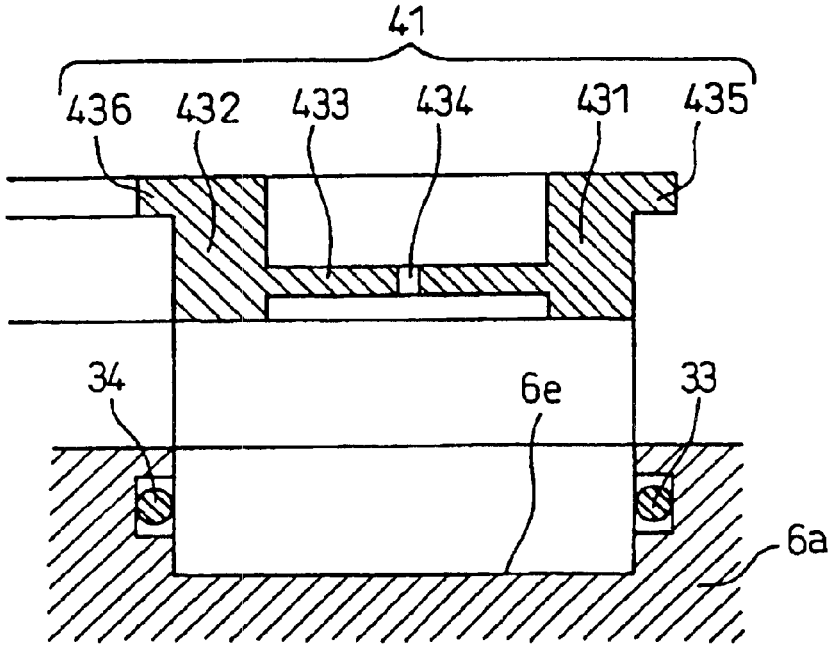
FIG. 22 is an enlarged sectional view of principal parts of a 20th embodiment.

The 20th embodiment shown in FIG. 22 is an application of the thinking of the 18th embodiment (FIG. 20) to the 19th embodiment (FIG. 21). That is, the characterizing features of the 20th embodiment lie in formation of a ring-shaped flange 435 projecting outward at a top end of the outer circumference of the outer seal ring part 431 and the formation of a ring-shaped flange 436 projecting inward at a top end of the inner circumference of the inner seal ring part 432. The effects are the combined effects of the 18th and 19 embodiments.

Figure 23:
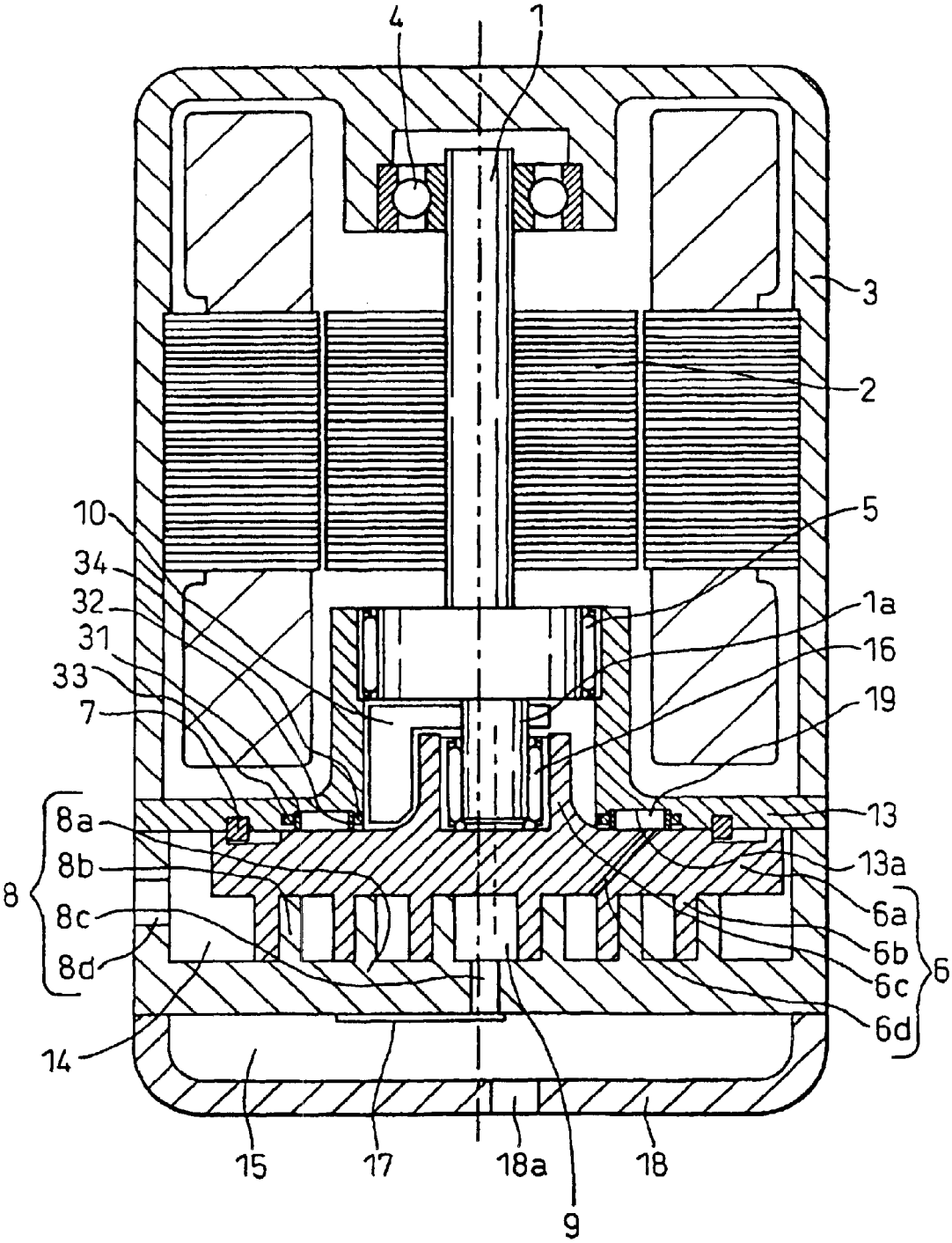
FIG. 23 is a longitudinal sectional view of a 21st embodiment of the present invention.

FIG. 23 shows a scroll compressor of a 21st embodiment of the present invention. The basic configuration and operation of the scroll compressor are the same as those of the first embodiment (FIG. 1). The characterizing feature of the 21st embodiment, in the same way as the case of the 13th embodiment (FIG. 14), lies in the configuration of the backpressure chamber 19, which was formed by the ring-shaped groove 6*e* formed in the end plate 6*a* of the movable scroll 6 in the scroll compressors of the first embodiment (FIG. 1), 14th embodiment (FIG. 15), etc., by a ring-shaped groove 13*a* formed at the middle housing 13 side. The configuration inside the backpressure chamber 19 in the principal part of the 21st embodiment, however, is the same as that of the 14th embodiment shown in FIG. 16, so the 21st embodiment exhibits effects substantially the same as those of the 14th embodiment. Therefore, modifications providing the backpressure chamber 19 at the middle housing 13 side as in the 21st embodiment may also be considered for the 18th embodiment shown in FIG. 20 to the 20th embodiment shown in FIG. 22.

Figure 24:
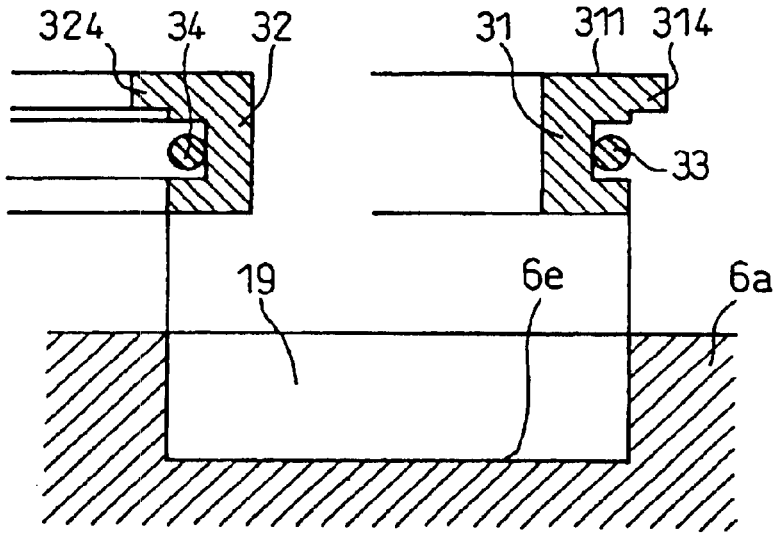
FIG. 24 is an enlarged sectional view of principal parts of a 22nd embodiment.

FIG. 24 shows principal parts of a 22nd embodiment of the present invention. The 22nd embodiment differs from the 15th embodiment shown in FIG. 17 in the point of the increased areas of the top surfaces 311 and 321 of the outer seal ring 31 and inner seal ring 32. This is due to the formation of the flanges 314 and 324 at the top surfaces 311 and 321. Due to this, similar effects to the 18th embodiment shown in FIG. 20 are exhibited. In other respects, the embodiment exhibits effects similar to those of the 15th embodiment.

Figure 25:
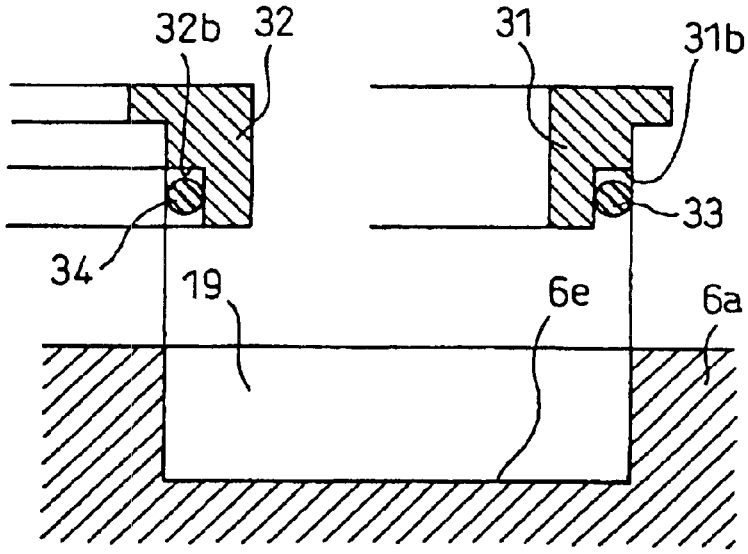
FIG. 25 is an enlarged sectional view of principal parts of a 23rd embodiment.

The 23rd embodiment shown in principal parts in FIG. 25 can be seen as a combination of the 16th embodiment shown in FIG. 18 and the 18th embodiment shown in FIG. 20. Therefore, in the 23rd embodiment, the effects of both the 16th embodiment and 18th embodiment are obtained.

Figure 26:
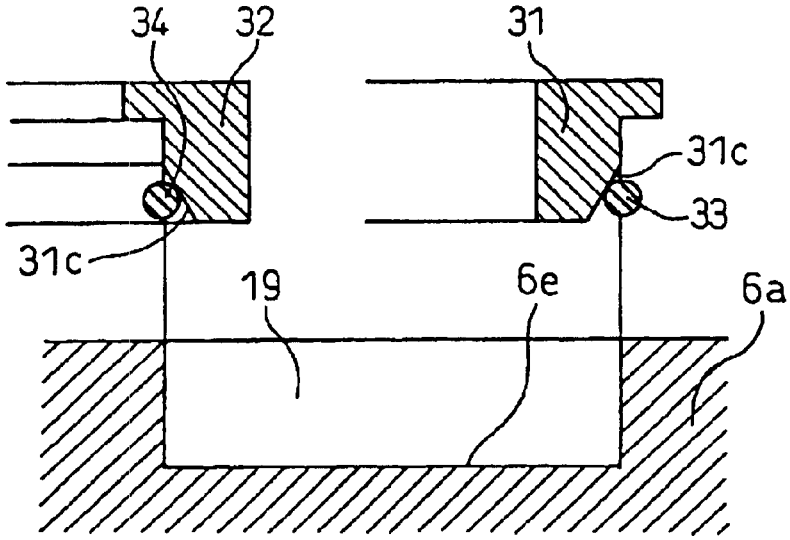
FIG. 26 is an enlarged sectional view of principal parts of a 24th embodiment.

From the same thinking, the 24th embodiment shown in principal parts in FIG. 26 can be seen as a combination of the 17th embodiment shown in FIG. 19 and the 18th embodiment shown in FIG. 20. Therefore, in the 24th embodiment, the effects of both the 17th embodiment and 18th embodiment are obtained.

Figure 27:
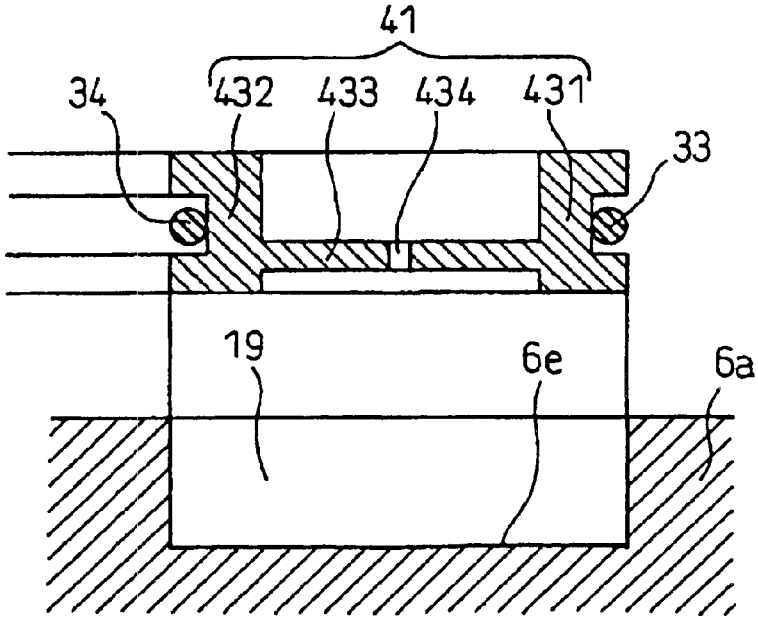
FIG. 27 is an enlarged sectional view of principal parts of a 25th embodiment.

The 25th embodiment shown in principal parts in FIG. 27 can be seen as a combination of the 15th embodiment shown in FIG. 17 and the 19th embodiment shown in FIG. 21. Therefore, in the 25th embodiment, the effects of both the 15th embodiment and 19th embodiment are obtained.

Figure 28:
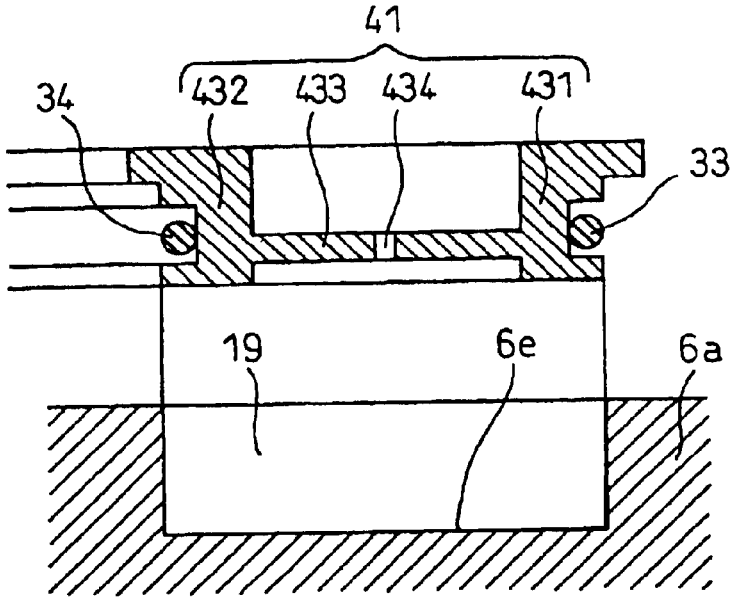
FIG. 28 is an enlarged sectional view of principal parts of a 26th embodiment.

From the same thinking, the 26th embodiment shown in principal parts in FIG. 28 can be seen as a combination of the 23rd embodiment shown in FIG. 25 and the 20th embodiment shown in FIG. 22. Therefore, in the 26th embodiment, the effects of both the 20th embodiment and 23rd embodiment are obtained.

Figure 29:
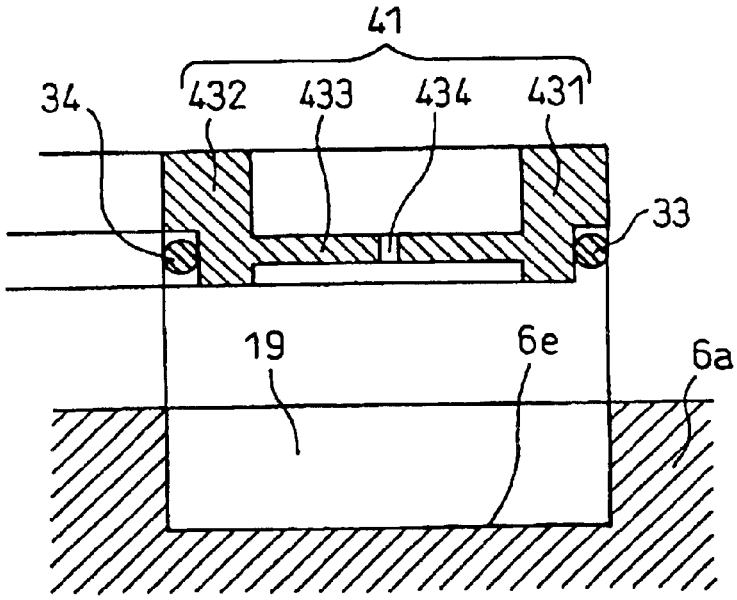
FIG. 29 is an enlarged sectional view of principal parts of a 27th embodiment.

The 27th embodiment shown in principal parts in FIG. 29 can be seen as a combination of the 16th embodiment shown in FIG. 18 and the 19th embodiment shown in FIG. 21. Therefore, in the 27th embodiment, the effects of both the 16th embodiment and 19th embodiment are obtained.

Figure 30:
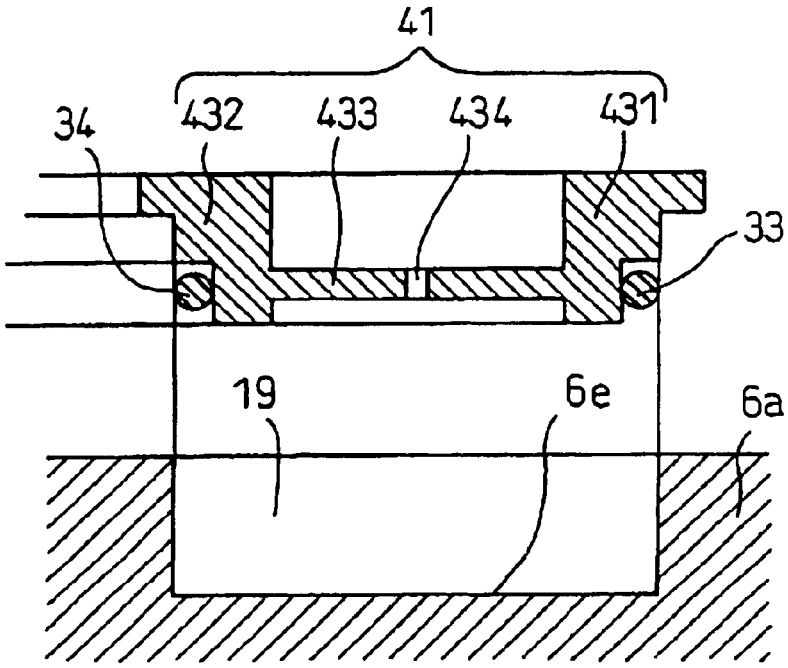
FIG. 30 is an enlarged sectional view of principal parts of a 28th embodiment.

From the same thinking, the 28th embodiment shown in principal parts in FIG. 30 can be seen as a combination of the 16th embodiment shown in FIG. 18 and the 20th embodiment shown in FIG. 22. Therefore, in the 28th embodiment, the effects of both the 16th embodiment and 20th embodiment are obtained.

Figure 31:
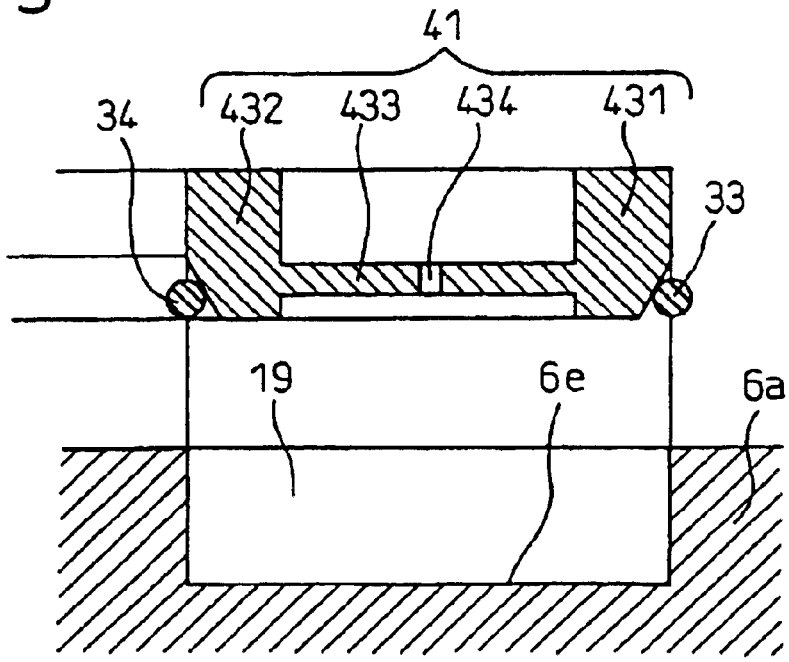
FIG. 31 is an enlarged sectional view of principal parts of a 29th embodiment.

The 29th embodiment shown in principal parts in FIG. 31 can be seen as a combination of the 17th embodiment shown in FIG. 19 and the 20th embodiment shown in FIG. 22. Therefore, in the 29th embodiment, the effects of both the 17th embodiment and 20th embodiment are obtained.

Figure 32:
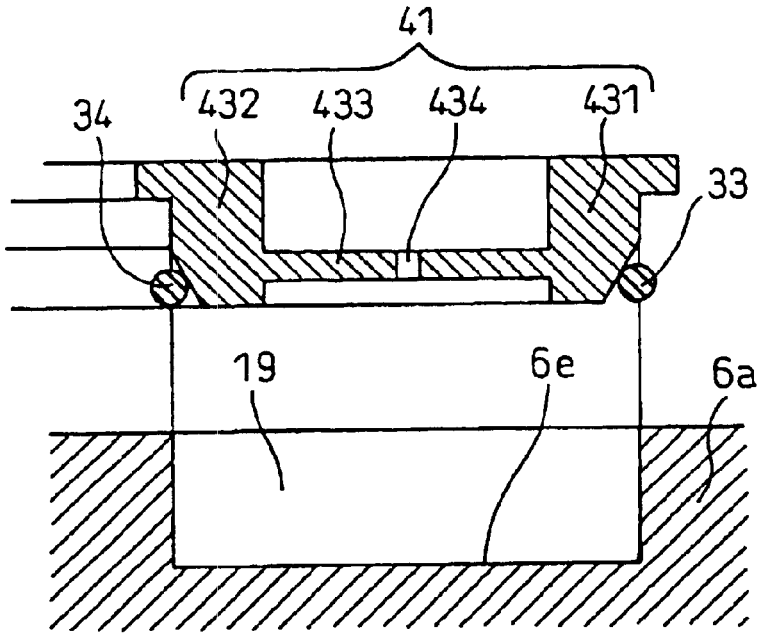
FIG. 32 is an enlarged sectional view of principal parts of a 30th embodiment.

Further, from the same thinking, the 30th embodiment shown in principal parts in FIG. 32 can be seen as a combination of the 29th embodiment shown in FIG. 31 and the 20th embodiment shown in FIG. 22. Therefore, in the 30th embodiment, the effects of both the 29th embodiment and 20th embodiment are obtained.

As clear from the above explanation, the biggest feature of the present invention is that the ring-shaped seal rings 11, 12, 31, 32 and the seal rings 211, 212, 221, 222, 431, 432, etc. receiving the pressure of the high-pressure fluid in the groove 6*e* or 13*a* forming the backpressure chamber 19 are configured to be pressed against the other surface by movement. To clarify this feature, the state of movement of the seal rings is illustrated all together from FIG. 33 to FIG. 35. The arrow marks in these figures show movement of the seal rings. The "movement" spoken of here does not mean only linear displacement and also includes inclination, that is, tilting.

While the invention has been described with reference to specific embodiments chosen for purpose of illustration, it should be apparent that numerous modifications could be made thereto by those skilled in the art without departing from the basic concept and scope of the invention.

What is claimed is:

1. A scroll compressor provided with a housing; a shaft having a crank part, which is offset, wherein said shaft is rotatably and axially supported by said housing; a movable scroll, which has a spiral shaped blade and an end plate and is driven to orbit by the crank part; and a fixed scroll, which has a spiral shaped blade that meshes with the movable scroll and an end plate and is fixed to said housing, such that, when said movable scroll is driven to orbit by the crank part of said shaft, a plurality of working chambers formed between the blade of said movable scroll and the blade of said fixed scroll move toward the center, and the volumes of the working chambers are successively reduced and fluid is compressed in the working chambers, said scroll compressor comprising:

a middle housing provided as part of said housing behind said movable scroll for supporting a thrust load in an axial direction of said shaft acting on said movable scroll along with the rise in the compression pressure of the fluid in the working chambers;

at least one ring-shaped groove forming a backpressure chamber in one of a back surface of the end plate of said movable scroll and a front surface of said middle housing facing and supporting the same;

a passage for introducing high-pressure fluid into said ring-shaped groove; and at least one ring-shaped seal ring fitted movably in said ring-shaped groove, wherein the sectional shape of said at least one ring-shaped seal ring is such that said seal ring slightly inclines in said ring-shaped groove, wherein said at least one seal ring includes a first seal ring fit along an outer circumference of said ring-shaped groove and a second seal ring fit along an inner circumference of said ring-shaped groove, each fabricated from rubber, plastic, or metal having wear resistance, oil resistance, and elasticity; said first seal ring forms a ring-shaped projection having an outer diameter larger than an outer circumference diameter of said ring-shaped groove in a no-load state before being fit in said backpressure chamber at a portion facing a portion close to the bottom surface of said ring-shaped groove in the outer circumference of said groove; and said second seal ring forms a ring-shaped projection having an inner diameter smaller than an inner circumference diameter of said ring-shaped groove in said no-load state at a portion facing a portion close to the bottom surface of said ring-shaped groove in the inner circumference of said groove.

2. A scroll compressor as set forth in claim 1, wherein part of at least one of the outer circumference of said first seal ring and inner circumference of said seal ring is formed with a tapered surface, whereby part of said ring-shaped projection forms an edge-shaped projecting rim.

3. A scroll compressor as set forth in claim 1, wherein said at least one seal ring includes a first seal ring fit along an outer circumference of said ring-shaped groove and having a rectangular sectional shape and a second seal ring fit along an inner circumference of said ring-shaped groove and having a rectangular sectional shape, each fabricated from rubber, plastic, or metal having wear resistance, oil resistance, and elasticity; said first seal ring has an outer diameter set larger than an outer circumference diameter of said ring-shaped groove in a no-load state before being fit in said backpressure chamber at a portion facing a portion close to the bottom surface of said ring-shaped groove; and said second seal ring has an inner diameter set smaller than an inner circumference diameter of said ring-shaped groove in said no-load state at a portion facing the inner circumference of said ring-shaped groove.

4. A scroll compressor as set forth in claim 1, further provided with an elastic member arranged between said first seal ring and said second seal ring for biasing said first seal ring toward an outer circumference of said ring-shaped groove and biasing said second seal ring toward an inner circumference of said ring-shaped groove.

5. A scroll compressor as set forth in claim 3, further provided with an elastic member arranged between said first seal ring and said second seal ring for biasing said first seal ring toward an outer circumference of said ring-shaped groove and biasing said second seal ring toward an inner circumference of said ring-shaped groove.

* * * * *